US010863276B2

(12) United States Patent
Walther et al.

(10) Patent No.: US 10,863,276 B2
(45) Date of Patent: Dec. 8, 2020

(54) SOUNDBAR

(71) Applicant: Fraunhofer-Gesellschaft zur Foerderung der angewandten Forschung e.V., Munich (DE)

(72) Inventors: Andreas Walther, Feucht (DE); Christian Borss, Erlangen (DE); Martin Schneider, Erlangen (DE); Philipp Goetz, Berlin (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/887,182

(22) Filed: Feb. 2, 2018

(65) Prior Publication Data

US 2018/0184202 A1 Jun. 28, 2018

Related U.S. Application Data

(63) Continuation of application No. PCT/EP2016/067393, filed on Jul. 21, 2016.

(30) Foreign Application Priority Data

Aug. 3, 2015 (EP) ..... 15179585

(51) Int. Cl.
*H04R 5/02* (2006.01)
*H04R 1/34* (2006.01)
(Continued)

(52) U.S. Cl.
CPC ..... *H04R 5/02* (2013.01); *H04R 1/345* (2013.01); *H04R 3/12* (2013.01);
(Continued)

(58) Field of Classification Search
CPC ... H04S 2400/01; H04S 2420/01; H04S 7/305
(Continued)

(56) References Cited

U.S. PATENT DOCUMENTS 2,179,840 A 11/1939 Bucky et al.
2,710,662 A 6/1955 Camras
(Continued)

FOREIGN PATENT DOCUMENTS

CN 101610438 A 12/2009
CN 201550266 U 8/2010
(Continued)

OTHER PUBLICATIONS

Anonymous, "Soundbar", Sep. 14, 2017; Wikipedia Online; Retrieved from the Internet: URL: https://en.wikipedia.org/wiki/Soundbar, Sep. 14, 2017.

*Primary Examiner* — Alexander Krzystan
(74) *Attorney, Agent, or Firm* — Perkins Coie LLP; Michael A. Glenn

(57) ABSTRACT

A soundbar includes a housing, at least two transducers of a first group and at least one transducer of a second group. The at least two transducers of the first group are arranged at the front side of the housing and configured to emit sound in a first direction in accordance with two first audio signals so as to reproduce a two dimensional sound field. The at least one transducer of a second group is arranged at second side of the housing and configured to emit sound in a second direction in accordance with a second audio signal such that the sound emitted by the at least one transducer of the second group reaches a predefined listener's position in a reflected manner to extend the two dimensional sound field in a height direction. The reflection reflecting the sound emitted by the at least one transducer of the second group has an order of at least two.

13 Claims, 18 Drawing Sheets

(51) Int. Cl.
*H04R 3/12* (2006.01)
*H04S 3/00* (2006.01)

(52) U.S. Cl.
CPC .. *H04R 2205/022* (2013.01); *H04R 2205/024* (2013.01); *H04S 3/002* (2013.01)

(58) Field of Classification Search
USPC ..... 381/63, 163, 303, 307
See application file for complete search history.

(56) References Cited

U.S. PATENT DOCUMENTS

| | | | | |
|---|---|---|---|---|
| 2,831,060 | A | 4/1958 | Kleis | |
| 2,896,736 | A | 7/1959 | Karlson | |
| 3,241,631 | A | 3/1966 | Manieri | |
| 3,582,553 | A | 6/1971 | Bose | |
| 3,627,948 | A | 12/1971 | Nichols | |
| 3,933,219 | A | 1/1976 | Butler | |
| 4,112,256 | A | 9/1978 | Carlsson | |
| 4,837,825 | A | 6/1989 | Shivers | |
| 5,809,150 | A | 9/1998 | Eberbach | |
| 5,953,432 | A | 9/1999 | Yanagawa et al. | |
| 6,175,489 | B1 | 1/2001 | Markow et al. | |
| 7,142,683 | B1 * | 11/2006 | Markow | H04R 1/025 381/333 |
| 8,194,863 | B2 | 6/2012 | Takumai et al. | |
| 8,345,883 | B2 | 1/2013 | Takumai et al. | |
| 2006/0065476 | A1 * | 3/2006 | Tasker | H04R 1/323 181/155 |
| 2006/0126878 | A1 | 6/2006 | Takumai et al. | |
| 2007/0019831 | A1 | 1/2007 | Usui | |
| 2007/0253583 | A1 * | 11/2007 | Melanson | H04R 3/12 381/303 |
| 2007/0263888 | A1 | 11/2007 | Melanson | |
| 2014/0126753 | A1 * | 5/2014 | Takumai | H04S 7/305 381/303 |
| 2016/0330562 | A1 * | 11/2016 | Crockett | G06F 3/162 |

FOREIGN PATENT DOCUMENTS

| | | | |
|---|---|---|---|
| CN | 102572651 | A | 7/2012 |
| CN | 102595282 | A | 7/2012 |
| DE | 3142462 | A1 | 5/1982 |
| DE | 3201455 | A1 | 7/1983 |
| EP | 0500294 | A2 | 8/1992 |
| EP | 1662842 | A1 | 5/2006 |
| EP | 2293596 | A2 | 3/2011 |
| EP | 2400782 | A1 | 12/2011 |
| FR | 2999855 | A1 | 6/2014 |
| GB | 2098025 | A | 11/1982 |
| JP | S53158233 | U | 12/1978 |
| JP | S59201600 | A | 11/1984 |
| JP | S61191694 | U | 11/1986 |
| JP | 2005064746 | A | 3/2005 |
| JP | 2013016925 | A | 1/2013 |
| WO | 2007127781 | A2 | 11/2007 |
| WO | 2007127821 | A2 | 11/2007 |
| WO | 2014036085 | A1 | 3/2014 |
| WO | 2014036121 | A1 | 3/2014 |
| WO | 2014107714 | A1 | 7/2014 |

* cited by examiner

SOUNDBAR

CROSS-REFERENCE TO RELATED APPLICATIONS

This application is a continuation of copending International Application No. PCT/EP2016/067393, filed Jul. 21, 2016, which is incorporated herein by reference in its entirety, and additionally claims priority from European Application No. EP 15 179 585.3, filed Aug. 3, 2015, which is incorporated herein by reference in its entirety.

Embodiments of the present invention refer to a soundbar, especially to a soundbar with height loudspeakers. Further embodiments refer to a system comprising a soundbar and a screen.

BACKGROUND OF THE INVENTION

Today's movie soundtracks are delivered in surround sound produced for a varying number of reproduction channels. The most recent audio formats offer the possibility of immersive sound reproduction. With immersive formats, the legacy surround sound formats (e.g. 5.1 or 7.1), which can only faithfully reproduce sound on a horizontal plane, are extended with loudspeakers positioned in different heights. Thereby a faithful reproduction of sound in a 3D space is possible.

While audio enthusiasts might install loudspeakers at useful positions—including height speakers—most consumers tend to avoid the effort of installing conventional surround sound setups. Hence, it can be expected that mounting additional loudspeakers on the ceiling will be favored by even less consumers. Nonetheless, those home consumers also want to benefit from enhanced sound quality.

To yield high-quality sound reproduction without the need to install standalone loudspeakers, soundbars have become popular. They offer better sound quality than most of the loudspeakers built into flat screens, and by special processing and loudspeaker layouts they even allow to reproduce virtual surround sound.

To reproduce three-dimensional acoustic scenes, the excited wave fronts may impinge on the listener's position also from a broad range of directions in the upper hemisphere. Hence, it is not sufficient that wave fronts travel only in the azimuthal plane. Instead, parts of the acoustic scene may be reproduced from above the listener's position, which is a major obstacle in the design of a compact playback system.

According to known technology there are some concepts for delivering 3D sound by using reflective surfaces. The reflected sound is specifically used to address the problem of 3D sound reproduction without the need to install height loudspeakers (which may also have a different frequency range when compared to the other loudspeakers). Such a system is described in the WO 2014/036085. Here, the loudspeaker system renders spatial audio content, wherein the sound is reflected off a surface like the ceiling to the listener's position. For this, one or more upward tilted drivers are provided. These are positioned such that they project sound at an angle up to the ceiling where it can then be bounced back down to the listener. The degree of the tilt may be set depending on listening environment characteristics and system requirements. For example, the upward firing driver may be tilted up between 30° and 60°. For certain sounds, such as ambient sound, the upward-firing driver may be pointed straight up out of an upper surface of the speaker enclosure to create what might be referred to as a 'top firing' driver. The upward-firing drivers would be positioned such that the angle between the median plane of the driver and the acoustic center would be an angle in the range of 45° to 180°. In the case of positioning the driver at 180°, the back-facing driver could provide sound diffusion by reflecting off of a back-wall. However, each embodiment according to WO 2014/036085 is described the context of 5.1 or 7.1 setups. Here, cabinets are placed in the traditional positions (5.1 or 7.1) and equipped with an additional driver pointing generally upwards but being slightly tilted towards the listener. The tilt of the driver is chosen such that the directional sound waves are reflected at the ceiling towards the listener position. This approach may not be optimal with regard to be sufficiently directional, especially for a broad frequency range. Thus, a considerable residual part of the emitted wave field reaches the listener directly, which can degrade the impression of a sound impinging from above. A solution according to WO 2014/036085 to this drawback is to apply filters that remove certain spatial cues from the emitted signal.

Another quite similar approach is published within the patent application WO 2014/107714, also referring to loudspeaker setups in which upward firing drivers are used for a height audio signal. Here, the above discussed drawback regarding the sufficient directionality for a broad frequency range may also be present.

In the patent applications U.S. Pat. Nos. 5,953,432 and 8,345,883 different approaches, being base on usage of beamforming, are revealed.

Some patent applications try to enhance the acoustic stage. For example, U.S. Pat. No. 2,179,840 shows loudspeakers playing back the content in three different frequency regions, wherein the loudspeakers are arranged such that they direct the sound towards the ceiling. From there, the reflected sound reaches the listener. According to this approach, this results in a better uniform distribution of the sound throughout the room.

The patent document U.S. Pat. No. 2,710,662 describes a sound diffusing projector for single channel or stereophonic sound reproduction. This projector generates virtual sources by using a loudspeaker slanted towards the side at the back of the device.

U.S. Pat. No. 2,831,060 shows methods of reproducing speech or music by means of loudspeakers radiating the sound to a listener partly directly and partly indirectly. U.S. Pat. No. 2,896,736 discloses a specific loudspeaker enclosure that enhances the reproduced sound field by using reflected sound. U.S. Pat. No. 3,241,631 describes a device that uses reflections from the wall in front of the listener instead of using side-wall reflections as the state of the art does. U.S. Pat. No. 3,582,553 describes a loudspeaker design that uses rearward-and-sideward oriented loudspeakers and second order reflections to reproduce stereophonic sound. U.S. Pat. No. 3,627,948 shows a loudspeaker design for stereophonic playback having forwardly and rearwardly as well as upward-slanted directed loudspeakers. U.S. Pat. No. 3,933,219 shows a loudspeaker design making use of using second order reflections from rear walls and 2nd side walls.

U.S. Pat. No. 4,112,256 discloses a loudspeaker design that emits different frequency ranges in different directions (upwards and towards the side) to achieve a considerably improved stereo reproduction. This has a liveliness and airiness to an extent which is missing with loudspeakers having their means facing straight forward.

U.S. Pat. No. 4,837,825 discloses an ambience recovery system that makes use of auxiliary loudspeakers positioned above a pair of conventional loudspeakers to physically separate the emitted additional sound by reflecting it off of sound-reflective surfaces.

To summarize, the advantages of the above discussed known technology is an enhancement in the spatial quality of the generated sound field, wherein the enhancement is based on the fact that reflected sound makes stereophonic reproduction better and more realistic. However, none of the above state of the art documents reveals an approach enabling to deliver immersive (i.e. 3D) sound reproduction in a home environment where placing loudspeakers around a listening space is not advantageous.

SUMMARY

According to an embodiment a soundbar to be arranged within a room such that a vertical surface within the room is used for a vertical reflection and a horizontal surface of the room is used for a horizontal reflection may have: a housing: at least two transducers of a first group arranged at a front side of the housing and configured to emit sound in a first direction in accordance with at least two first audio signals including many channels so as to reproduce a two dimensional sound field; and at least one transducer of a second group arranged at a second side of the housing and configured to emit sound in a second direction in accordance with at least one second audio signal such that the sound emitted by the at least one transducer of the second group reaches a predefined listener position in a reflected manner to extend the two dimensional sound field in a height dimension; wherein a height audio signal of a 3D surround reproduction is reproduced using one or more transducers of the second group; wherein the sound emitted by the at least one transducer of the second group is reflected by the vertical surface first and by the horizontal surface second, wherein the reflection reflecting the sound emitted by the at least one transducer of the second group has an order of at least two.

According to another embodiment a system may have: an inventive soundbar; and a screen for reflecting the sound emitted by the at least one transducer of the second group or a vertical reflector for reflecting the sound emitted by the at least one transducer of the second group and/or a horizontal reflector for reflecting the sound emitted by the at least one transducer of the second group.

According to another embodiment a system may have: a soundbar and a screen, wherein the soundbar is to be arranged within a room such that a vertical surface within the room is used for a vertical reflection and a horizontal surface of the room is used for a horizontal reflection and wherein the soundbar includes: a housing: at least two transducers of a first group arranged at a front side of the housing and configured to emit sound in a first direction in accordance with at least two first audio signals including many channels so as to reproduce a two dimensional sound field; and at least one transducer of a second group arranged at a second side of the housing and configured to emit sound in a second direction in accordance with at least one second audio signal such that the sound emitted by the at least one transducer of the second group reaches a predefined listener position in a reflected manner to extend the two dimensional sound field in a height dimension; wherein a height audio signal of a 3D surround reproduction is reproduced using one or more transducers of the second group, wherein the sound emitted by the at least one transducer of the second group is reflected by the vertical surface first and by the horizontal surface second, wherein the reflection reflecting the sound emitted by the at least one transducer of the second group has an order of at least two, wherein the sound emitted by the at least one transducer of the second group is shielded by a back surface of the screen such that the screen forms a barrier shielding the sound that is erroneously emitted within the first direction.

According to another embodiment a system may have: a soundbar; and a screen for reflecting the sound emitted by the at least one transducer of the second group or a vertical reflector for reflecting the sound emitted by the at least one transducer of the second group and a horizontal reflector for reflecting the sound emitted by the at least one transducer of the second group; wherein the soundbar is to be arranged within a room such that a vertical surface within the room is used for a vertical reflection and a horizontal surface of the room is used for a horizontal reflection and wherein the soundbar includes: a housing: at least two transducers of a first group arranged at a front side of the housing and configured to emit sound in a first direction in accordance with at least two first audio signals including many channels so as to reproduce a two dimensional sound field; and at least one transducer of a second group arranged at a second side of the housing and configured to emit sound in a second direction in accordance with at least one second audio signal such that the sound emitted by the at least one transducer of the second group reaches a predefined listener position in a reflected manner to extend the two dimensional sound field in a height dimension; wherein a height audio signal of a 3D surround reproduction is reproduced using one or more transducers of the second group; wherein the sound emitted by the at least one transducer of the second group is reflected by the vertical surface first and by the horizontal surface second, wherein the reflection reflecting the sound emitted by the at least one transducer of the second group has an order of at least two.

According to another embodiment a soundbar arranged within a room such that a vertical surface within the room is used for a vertical reflection and a horizontal surface of the room is used for a horizontal reflection may have: a housing: at least two transducers of a first group arranged at a front side of the housing and configured to emit sound in a first direction in accordance with at least two first audio signals including many channels so as to reproduce a two dimensional sound field; and at least one transducer of a second group arranged at a second side of the housing and configured to emit sound in a second direction in accordance with at least one second audio signal such that the sound emitted by the at least one transducer of the second group reaches a predefined listener position in a reflected manner to extend the two dimensional sound field in a height dimension; wherein a height audio signal of a 3D surround reproduction is reproduced using one or more transducers of the second group; wherein the sound emitted by the at least one transducer of the second group is reflected by the vertical surface first and by the horizontal surface second, wherein the reflection reflecting the sound emitted by the at least one transducer of the second group has an order of at least two.

According to another embodiment a soundbar may have: a housing: at least two transducers of a first group arranged at a front side of the housing and configured to emit sound in a first direction in accordance with at least two first audio signals so as to reproduce a two dimensional sound field; and at least one transducer of a second group arranged at a second side of the housing and configured to emit sound in a second direction in accordance with at least one second audio signal such that the sound emitted by the at least one transducer of the second group reaches a predefined listener position in a reflected manner to extend the two dimensional sound field in a height dimension; wherein a height audio signal of a 3D surround reproduction is reproduced using at least one transducer of the second group; wherein the first and the second direction form an angle of more than 90°; or wherein the housing includes a recess within the second side and wherein the at least one transducer of the second group is arranged within the recess; and wherein the at least one transducer of the second group is arranged at one plane of the V-shaped recess which is turned away from the front side.

According to another embodiment a system may have: a soundbar and a screen, wherein the soundbar includes: a housing: at least two transducers of a first group arranged at a front side of the housing and configured to emit sound in a first direction in accordance with at least two first audio signals so as to reproduce a two dimensional sound field; and at least one transducer of a second group arranged at a second side of the housing and configured to emit sound in a second direction in accordance with at least one second audio signal such that the sound emitted by the at least one transducer of the second group reaches a predefined listener position in a reflected manner to extend the two dimensional sound field in a height dimension; wherein a height audio signal of a 3D surround reproduction is reproduced using at least one transducer of the second group, wherein the sound emitted by the at least one transducer of the second group is shielded by a back surface of the screen such that the screen forms a barrier shielding the sound that is erroneously emitted within the first direction.

According to another embodiment a system may have: a soundbar; and a screen for reflecting the sound emitted by the at least one transducer of the second group or a vertical reflector for reflecting the sound emitted by the at least one transducer of the second group and a horizontal reflector for reflecting the sound emitted by the at least one transducer of the second group; wherein the soundbar includes: a housing: at least two transducers of a first group arranged at a front side of the housing and configured to emit sound in a first direction in accordance with at least two first audio signals so as to reproduce a two dimensional sound field; and at least one transducer of a second group arranged at a second side of the housing and configured to emit sound in a second direction in accordance with at least one second audio signal such that the sound emitted by the at least one transducer of the second group reaches a predefined listener position in a reflected manner to extend the two dimensional sound field in a height dimension; wherein a height audio signal of a 3D surround reproduction is reproduced using at least one transducer of the second group; wherein the sound emitted by the at least one transducer of the second group is reflected by the screen or the vertical reflector first and by the horizontal reflector second, wherein the reflection reflecting the sound emitted by the at least one transducer of the second group has an order of at least two.

Another embodiment may have a use of a soundbar arranged within a room such that a vertical surface within the room is used for a vertical reflection and a horizontal surface of the room is used for a horizontal reflection, the soundbar including: a housing; at least two transducers of a first group arranged at a front side of the housing and configured to emit sound in a first direction in accordance with at least two first audio signals so as to reproduce a two dimensional sound field; and at least one transducer of a second group arranged at a second side of the housing and configured to emit sound in a second direction in accordance with at least one second audio signal such that the sound emitted by the at least one transducer of the second group reaches a predefined listener position in a reflected manner to extend the two dimensional sound field in a height dimension; wherein a height audio signal of a 3D surround reproduction is reproduced using at least one transducer of the second group; wherein the sound emitted by the at least one transducer of the second group is reflected by the vertical surface first and by the horizontal surface second, wherein the reflection reflecting the sound emitted by the at least one transducer of the second group has an order of at least two.

An embodiment of the invention provides a soundbar comprising a housing and at least two transducers of a first group and at least one transducer of a second group. The at least two transducers of a first group are arranged at a front side of the housing and configured to emit sound in a first direction in accordance with two first audio signals so as to reproduce a two dimensional sound field. The at least one transducer of a second group is arranged at the second side of the housing and configured to emit sound in a second direction in accordance with at least one second audio signal such that the sound emitted by the at least one transducer of the second group reaches a predefined listener's position in a reflected manner to extend the two-dimensional sound field in a height direction. The reflection utilized for the sound emitted by the at least one transducer of the second group has an order of at least two.

Teachings disclosed herein are based on the principle that a soundbar enabling the reproduction of virtual two dimensional surround sound may be enhanced with additional transducers for the height signal. The height signal is reproduced using one or more transducers of a second group which are arranged such that they emit sound in a different direction, e.g. towards the ceiling, or first to the back wall and after reflecting the signal at the back wall up to the ceiling such that the signal reflected by the ceiling impinges the listener at the listener's position. This manner of reflecting the signal, which may also be referred to as second order reflection, has benefits with regards to the directionality of the (height) sound signal. That is, that only one single enclosure containing a plurality of loudspeakers is used to enable three-dimensional spatial sound reproduction.

According to the embodiments, the soundbar is arranged within the room such that the back wall (i.e. the wall behind the soundbar as seen from the listener's direction) is used for the vertical reflection (first reflection) and the ceiling is used for the horizontal reflection (second reflection). According to further embodiments a screen, which may be arranged adjacent to the soundbar or at the soundbar, may be used for vertically reflecting the sound. According to a further option, the sound is emitted behind the screen such that the sound signal to be transmitted in a reflected manner is shielded by the screen, which forms a kind of a barrier. In order to arrange the screen in the correct position relatively to the soundbar, the soundbar may comprise means for mounting the screen.

Further embodiments refer to the arrangement of the at least one transducer of a second group relatively to the at least two transducers of the first group. Here, the at least one transducer of the second group has a tilt such that the second direction and the first direction form an angle of at least 90° or more. Therefore, the transducers of the two groups may also comprise an exterior angle β in between. Alternatively, the angle of the first and second direction may be formed using beamforming. According to further embodiments, the housing may have a recess, e.g. at the top side, wherein the at least one transducer of the second group is arranged within this recess. According to embodiments, the recess may have a V-shape such that the at least one transducer of the second group is arranged at a plane of the V-shaped recess which is turned away from the front side at which the transducers of the first group are arranged. Thus, the transducers of the first and second groups have an enclosed/interior angle α of less than 90°, e.g. 80°. Thus, it is ensured that the second direction directs to the back wall (if the first direction is directed in parallel to the floor of the room, which is the typical arrangement of a soundbar) so as to enable the second order reflections. Note that the recess may have a different shape (depending on its optimization for the used transducers) and could serve the purpose to enable wave-guiding (i.e. forming a waveguide).

According to further embodiments, the transducers of the first and the second group are of the same type, i.e. that transducers have the same frequency response. Due to this, the reproduction of dedicated channels over the entire relevant frequency range at distinct different positions is enabled.

A further embodiment provides a system comprising the above described soundbar and a screen for reflecting the sound emitted by the at least one transducer of the second group. Alternatively to the screen, the soundbar may have a vertical reflector, e.g. for the case a projector is used. Additionally, a horizontal reflector may be used, e.g. in case the ceiling is too high.

BRIEF DESCRIPTION OF THE DRAWINGS

Embodiments of the present invention will be detailed subsequently referring to the appended drawings, in which.

DETAILED DESCRIPTION OF THE INVENTION

Figure 1A:
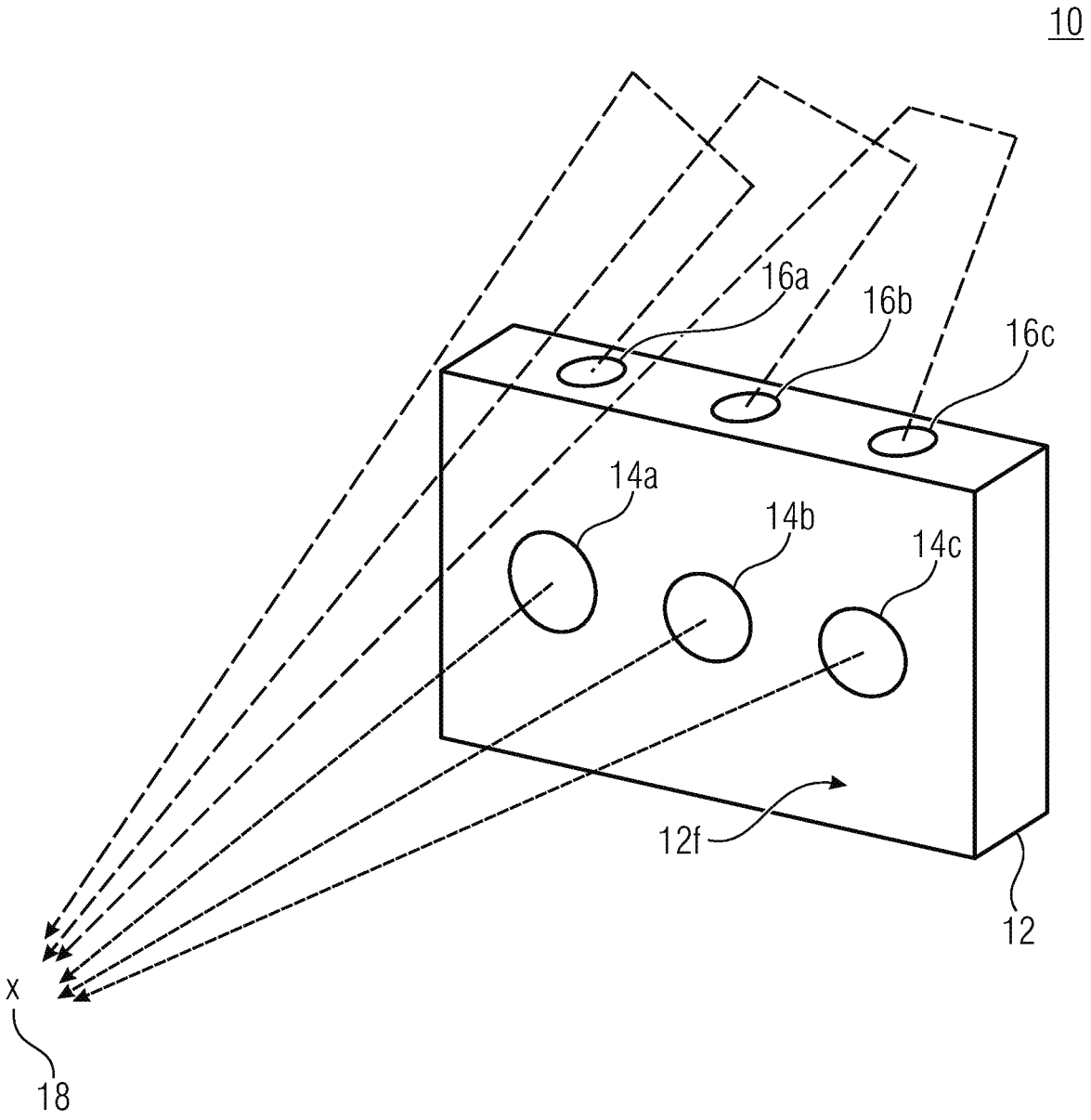
FIG. 1*a*, 1*b* show a soundbar according to a basic embodiment.

Below, embodiments of the present invention will subsequently be discussed referring to the figures. Here, reference numerals are provided to objects having the same or similar function, so that the description thereof is mutually applicable and interchangeable.

FIG. 1*a* shows a soundbar 10 comprising the housing 12 and at least two transducers of a first group 14*a* to 14*c* and at least one transducer of a second group 16*a* to 16*c*. As illustrated, the transducers 14*a* to 14*c* are arranged at a front side 12*f* of the housing 12, wherein the transducers 16*a* to 16*c* are arranged on another side, e.g. the top side of the housing 12.

Figure 1B:
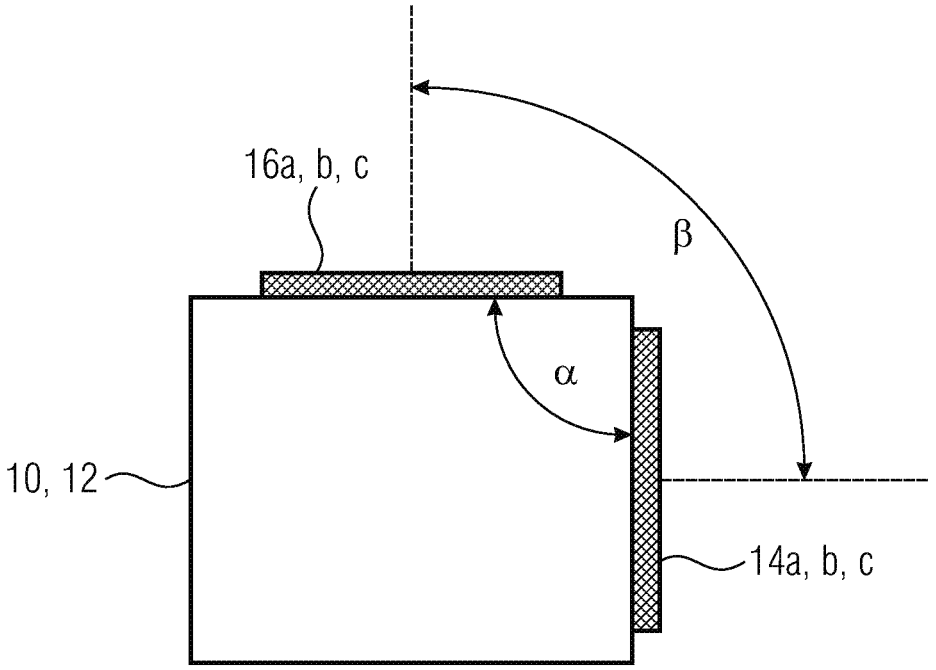

From another point of view, that means that the transducers 14*a* to 14*c* as well as the transducers 16*a* to 16*c* form a tilt having an angle α of 90° or less, cf. FIG. 1*b* illustrating a side view of the soundbar 12. Due to the tilt the first direction into which the transducers 14*a* to 14*c* emit sound and the second direction into which the transducers 16*a* to 16*c* emit sound form an angle β in between which has 90° or more (cf. FIG. 1*b*). Note that the transducers 14*a* to 14*c* and 16*a* to 16*c* of the different groups are advantageously, but not necessarily, of the same type.

For example, the transducers 14*a* to 14*c* emit sound substantially in a direction in parallel to the floor, i.e. directly to the listener at listening position 18 so as to enable two-dimensional surround sound. It should be noted that the surround sound is based on the common principle of producing virtual surround sound using a soundbar. Virtual surround sound means that a single soundbar generates sound seeming to come from directions where no loudspeakers are posited. The sound emitted by the transducers 16*a* to 16*c* is radiated in a direction basically against the wall behind the soundbar 10, such that the sound is reflected at the vertical wall. The sound reflected at the wall travels now in the direction towards the ceiling, at which the sound is reflected again. The second direction is slanted such that the sound reaches the listener at the listening position 18 after being reflected twice. Due to the fact that the sound travels from the ceiling to the listener at the position 18, the radiated sound wave mainly reaches the listener from above. Therefore, it is possible to use these second order reflections for height reproduction. From another point of view that means that the two-dimensional sound reproduction provided by the transducers 14*a* to 14*c* is extended vertically to form a three-dimensional sound reproduction at the listener's position 18.

From the point of view describing the (electrical) audio signals for controlling of the soundbar 10 it should be noted that the transducers 14*a* and 14*c* are typically controlled using, for example, two different audio signals (in order to enable two dimensional sound reproduction), wherein the transducers 16*a* to 16*c* are typically controlled by another audio signal.

Figure 2A:
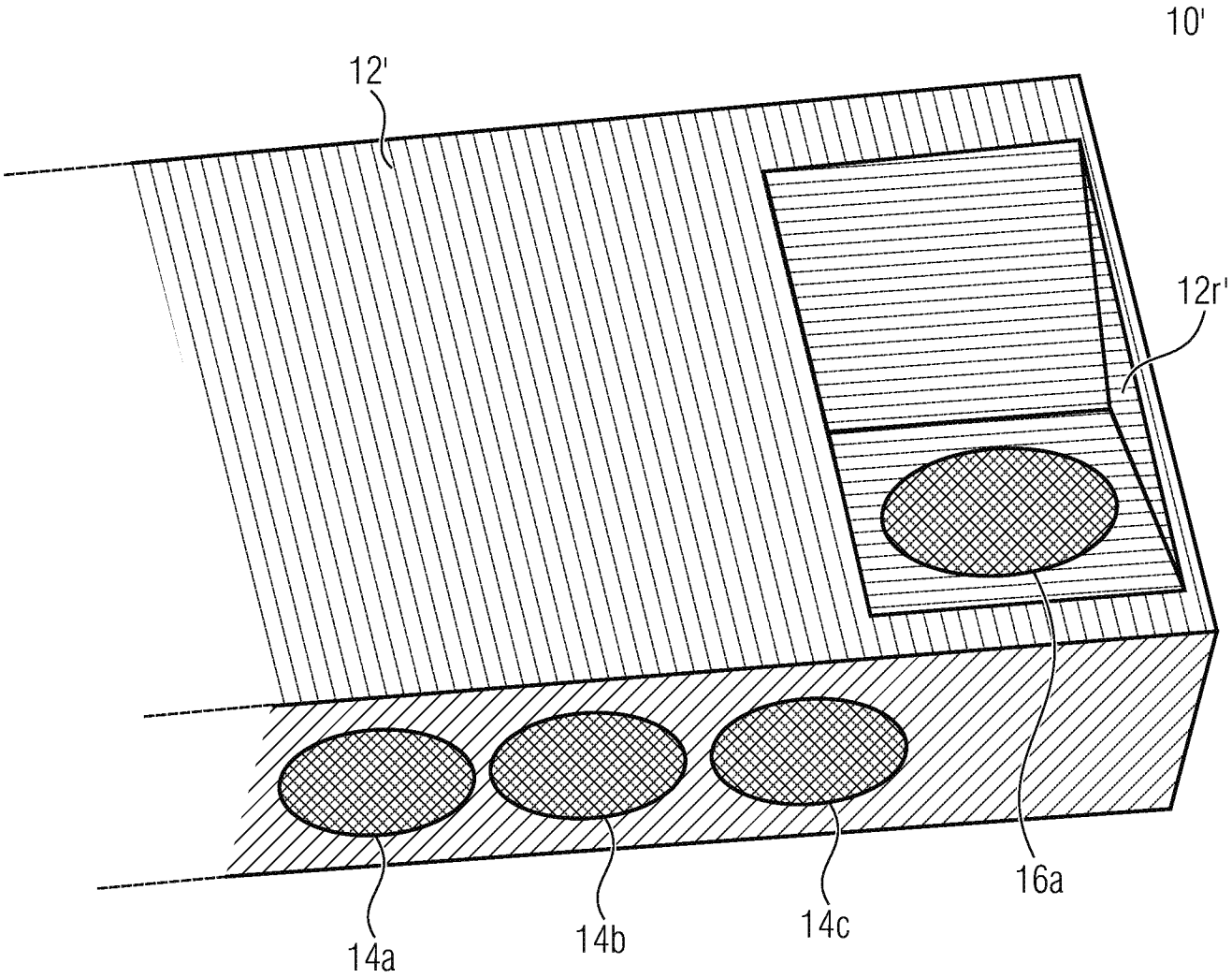
FIGS. 2*a*, 2*b* show different perspectives of a soundbar according to an enhanced embodiment.
Figure 2B:
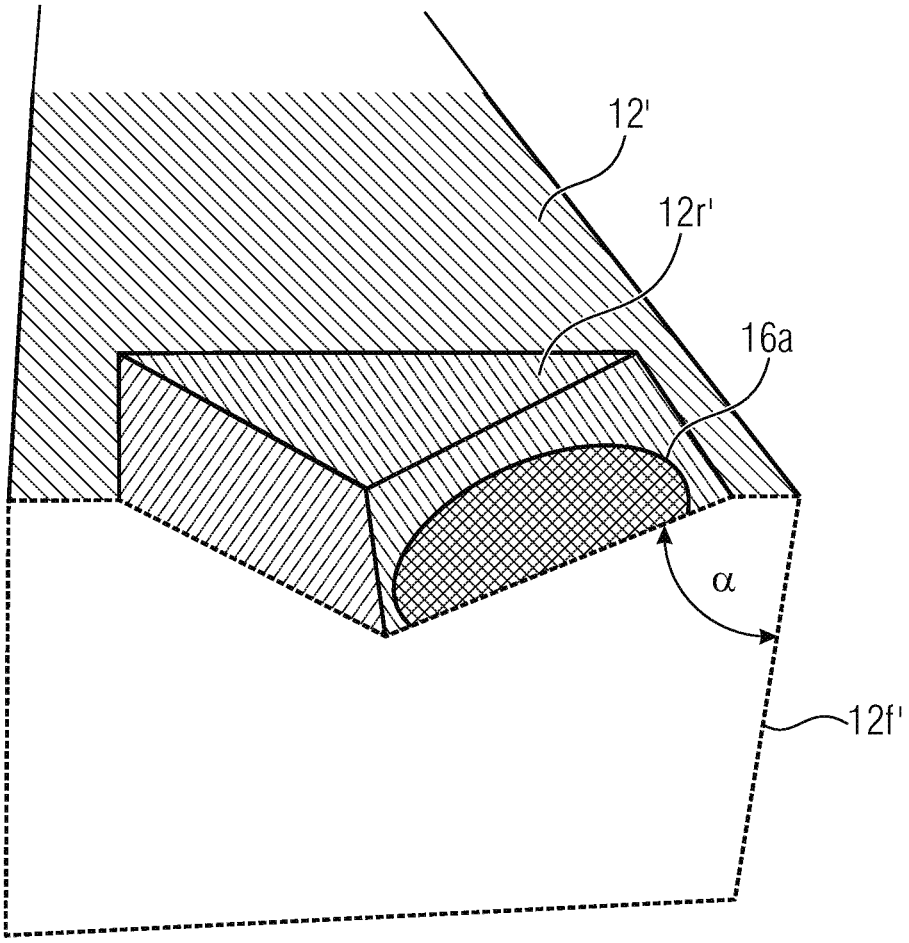

FIG. 2*a* shows a top view of a soundbar 10' with three transducers 14*a* to 14*c* facing horizontally (e.g. towards the listening area) and one exemplary transducer 16*a* on the right side of the housing 12', wherein the transducer 16*a* faces backward and upward back slanted away from the listening area. For this, the transducer 16*a* is arranged within a recess 12*r'* of the housing 12', wherein the recess 12*r'* may have a V-shape. The transducer 16*a* is arranged at a plane of the recess 12*r'* which forms together with the front 12*f'* of the housing 12' (onto which the transducers 14*a* to 14*c* are arranged) an acute angle α. This angle is illustrated by FIG. 2*b*.

Thus, the soundbar-like device 10' can be defined as follows: a device 10' that comprises at least three loudspeaker drivers 14*a* to 14*c* and 16*a* that are primarily excited in the same frequency range. This device 10' is typically located near the bottom of a television screen, such that a dimension and width are comparable to those of a typical TV screen. A height is typically well below 30 cm, while a depth can vary such that it can, e.g. be conventionally placed in front of a TV screen or the TV screen can be based on the device itself. The loudspeaker drivers 14*a* to 14*c* and 16*a* may or may not share an enclosure 12', but they will in any case be mechanically connected to each other such that their relative position to each other is fixed or can be fixed, i.e. that the housing does not necessarily form a volume for the transducers 14*a* to 14*c* and 16*a*. Although such device 10' is typically used in conjunction with a TV screen, a standalone usage for music or radio reproduction is also possible.

In such a soundbar-like device 10' at least one loudspeaker driver 16*a* is arranged or electrically steered such that it emits a sound wave that is consecutively reflected by a vertically oriented surface (like a wall) and then by a horizontally oriented surface before it impinges in the listening area (not shown). Using such a second order reflection is a crucial aspect of this invention. Arranging a loudspeaker basically means to tilt it accordingly, while an electrical steering can be facilitated using multiple drivers combined with array processing techniques.

Loudspeaker drivers 16*a* used for height reproduction will typically be mounted on top of the housing 12' and principally emit the sound in an upward direction.

To achieve reflections on at least two surfaces, it is additionally beneficial to facilitate a primary radiation direction that is slightly pointing away from the intended listening position.

Due to this, the so-called precedence effect may be avoided. The precedence effect, which often influences the state of the art approaches, has the following background. Since neither tilting a conventional loudspeaker nor an electrical steering can achieve a perfect directional reproduction, the sound emission in the desired direction is accompanied by undesired sound emission. If such an undesired sound emission arrives earlier at the listener and with a certain sound pressure level, the reproduction signal will no longer be perceived as coming from above. Since the undesired sound emission is stronger in directions close to the desired direction, it is a clear advantage to aim at a primary radiation direction away from the listener. In contrast, the state-of-the-art proposes a radiation upwards but tilted towards the listener's position (cf. WO 2014/036085). This orientation is unavoidable when exploiting only first-order reflections. Due to the usage of second order reflections, the means for reducing the precedence effect, e.g. a filter for the high channels, are no longer needed.

Figure 2C:
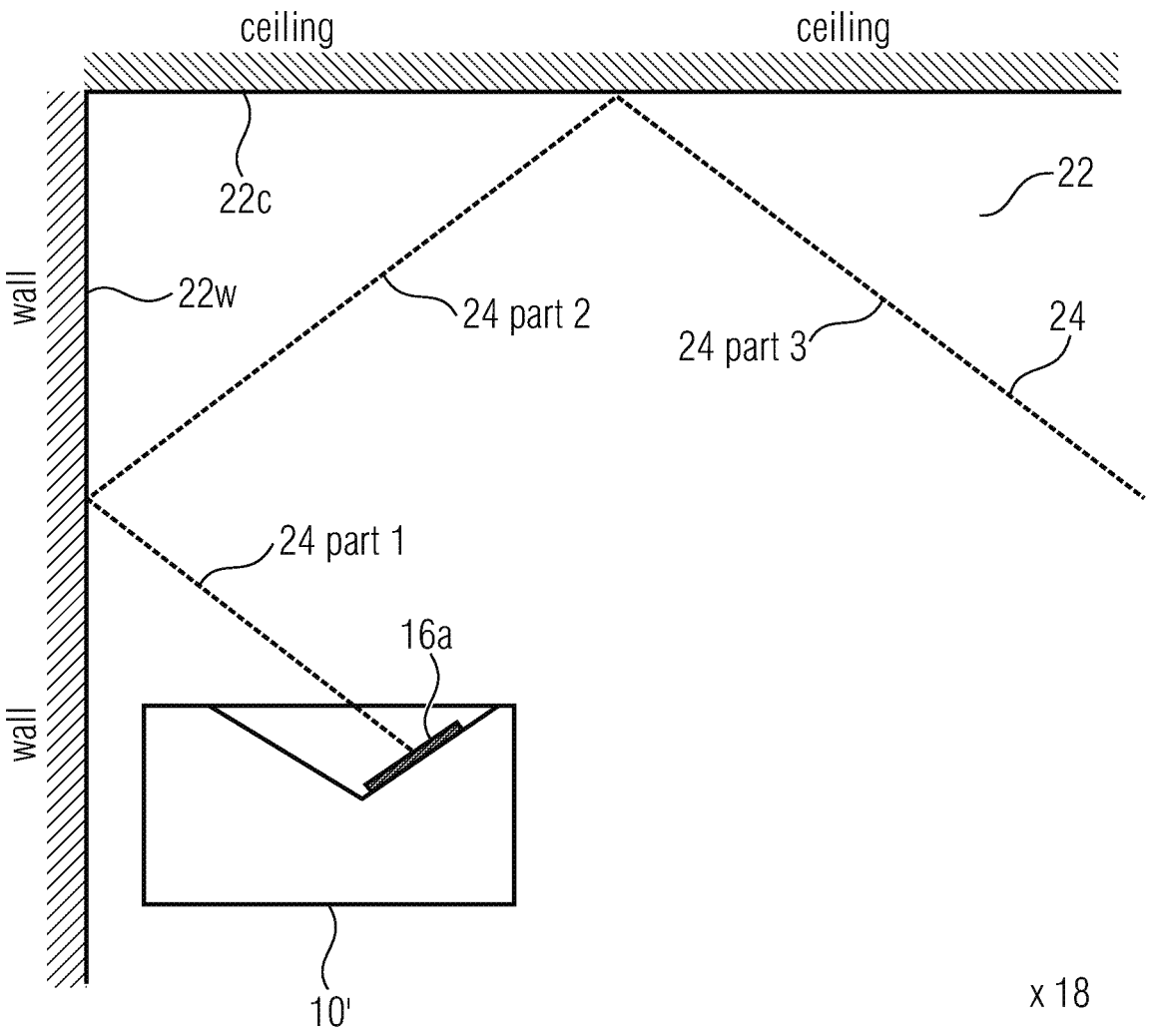
FIGS. 2*c*-2*g* show exemplary setups of the soundbar of FIGS. 2*a*, 2*b;*

Using second order reflections, the path from a loudspeaker driver to the listener is longer than for a first order reflection. The path (cf. reference numeral 24) is illustrated by FIG. 2*c*. FIG. 2*c* shows the soundbar 10' arranged within a room 22 having the walls 22*w* and the ceiling 22*c*. The soundbar 10' is arranged next to the wall 22*w* such that the signal output by the transducer 16*a* is directed against the wall 22*w* (cf. path 24, part 1). After being reflected, the path is between the wall 22*w* and ceiling 22*c* (cf. 24, part 2). Here, the signal is reflected such that it travels from the ceiling 22*c* to the listener at the listening position 18 (cf. 24, part 3).

The traveling path 24 from driver 16*a* to the listener position 18 is slightly longer than the traveling path of the first order reflection at the ceiling 22*c* causing only a small attenuation of the desired sound coming from above. But since tilting away the driver from the listener has an even stronger attenuation effect on the undesired direction, e.g. the first direction into which the transducers 14*a* to 14*c* of the first group emit the sound, this results in an overall improvement of the desired signal to inference signal ratio. Furthermore, the longer traveling path has the additional benefit of broadening the area which is covered by the sound reflected from the ceiling 22*c*. A directive reproduction with a given opening angle limits the effective listening area. Hence, a longer traveling distance to the emitted wave front will effectively increase the area where an optimum reproduction is achieved.

Figure 2D:
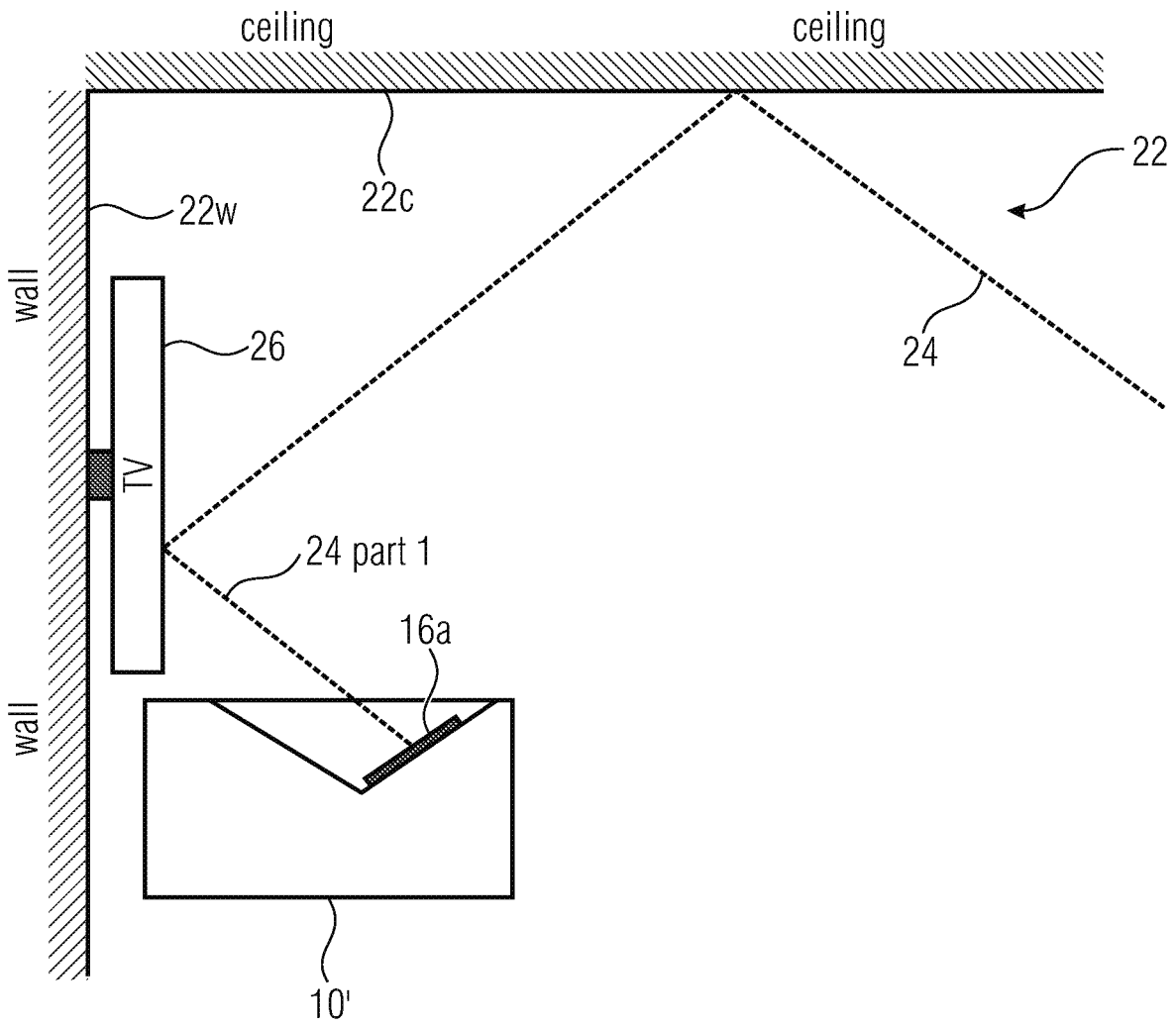
Figure 2E:
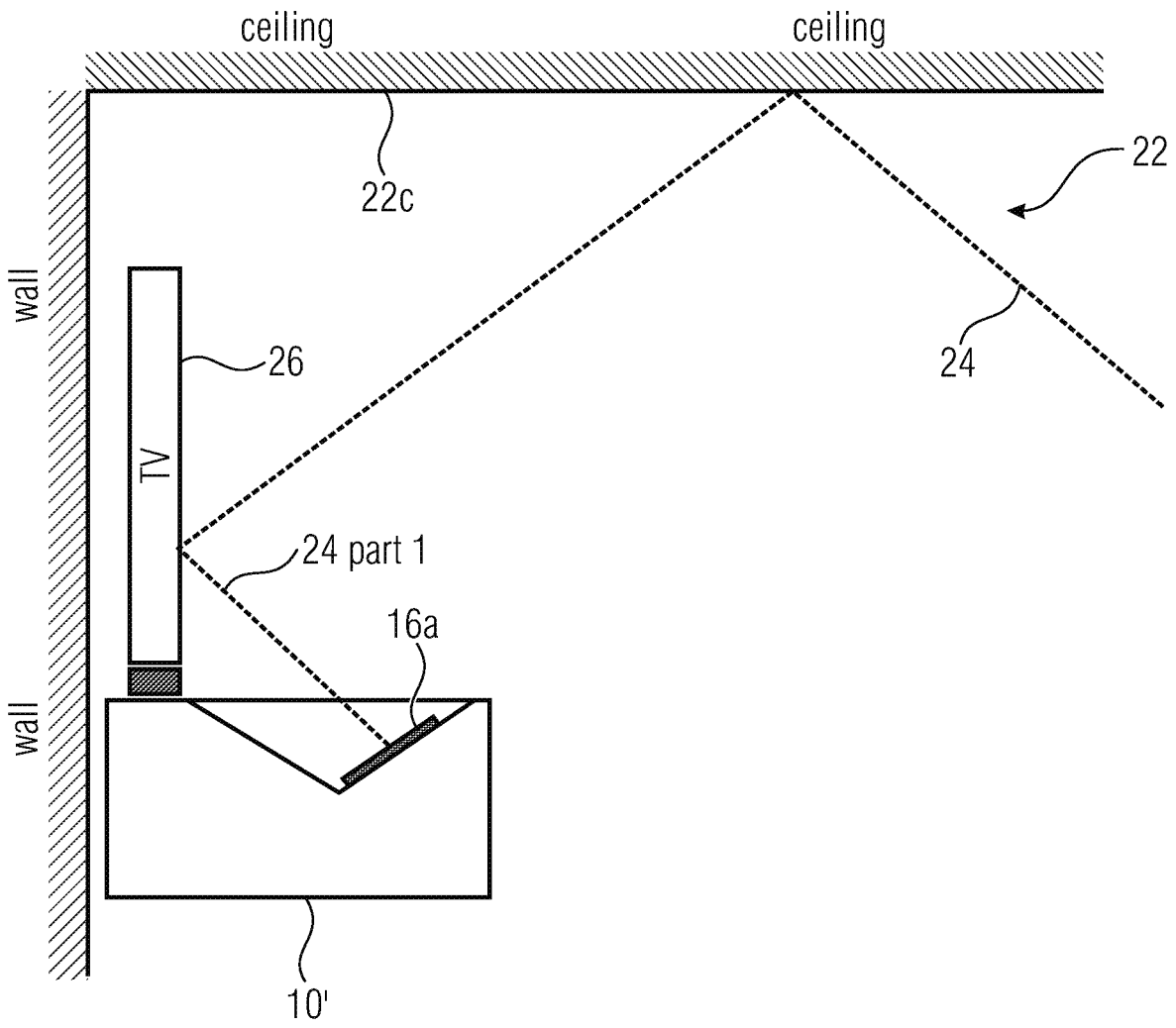

Seen from the listener's position 18, there are two essentially different options to place the driver 16*a* or the soundbar 10'. The driver 16*a*/soundbar 10' can be placed in front of the TV screen 26 as illustrated by FIG. 2*d* or 2*e*. FIGS. 2*d* and 2*e* show the soundbar 10' within the room 22, wherein the sound path 24 or especially part 1 of the sound path 24, i.e. 24, part 1, is emitted to the TV screen 26 which reflects the sound to the ceiling 22*c*. The difference between the embodiments 22*d* and 22*e* is that the screen 26 is mounted on the wall in case of the embodiment of 22*d*, wherein the television (screen) is positioned on the pedestal soundbar 10' within the embodiment of 22*e*. From another point of view, that means that the soundbar 10' may comprise means for mounting the screen 26. This has two advantages, namely that the soundbar 10' and the television 26 may be arranged somewhere in the room 22 without the need of having the wall 22*w* behind the soundbar 10'.

Figure 2F:
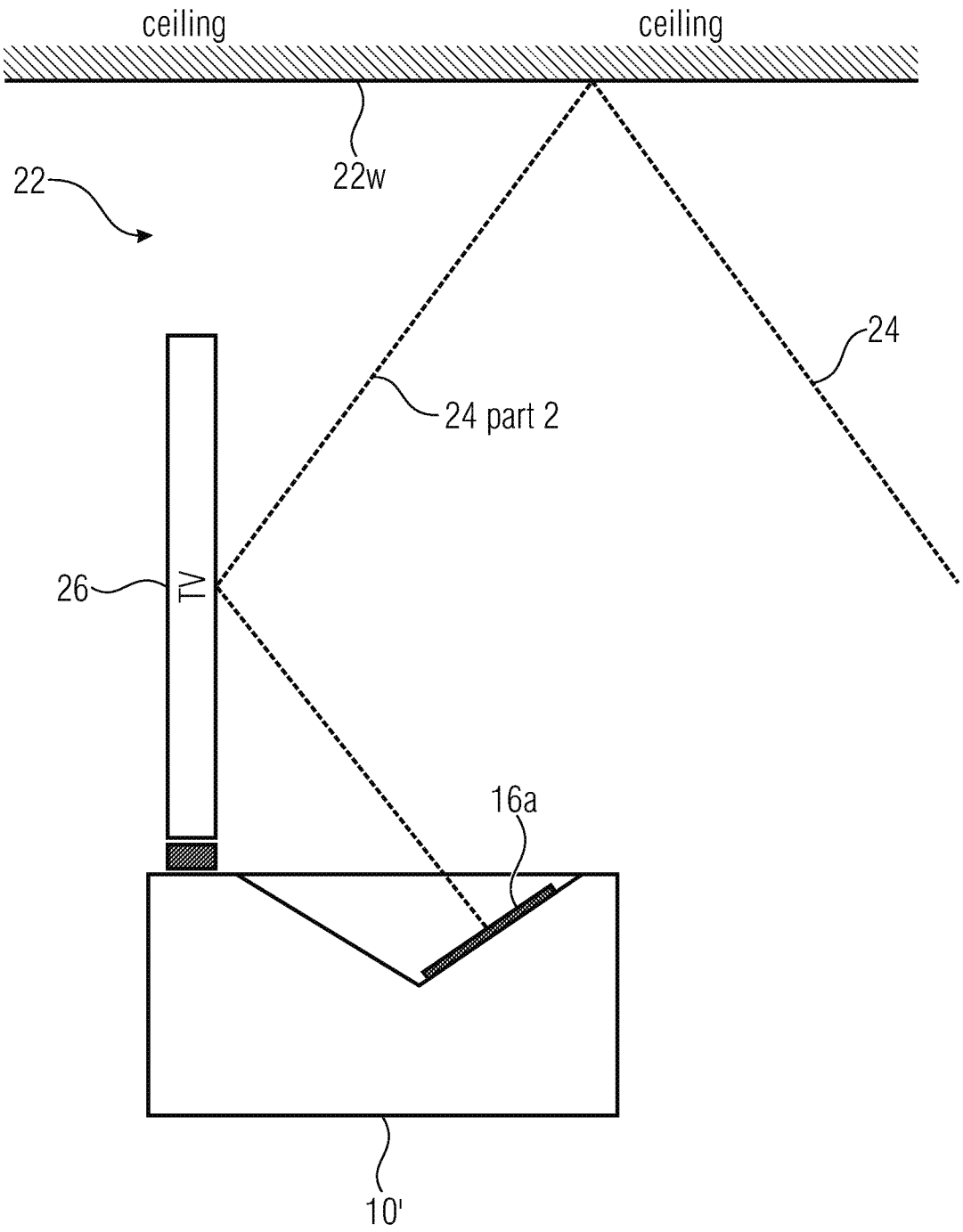

This setup is illustrated by FIG. 2*f* showing soundbar 10' in combination with the screen 26, wherein both are positioned in the middle of the room 22. As can be seen, the signal emitted by the transducer 16*a* reaches the ceiling 22*w* after being reflected by the screen 26 (cf. 24 part 2 of the path 24). Another advantage is that the vertical reflecting element, namely the television screen 26 is fixed and the position thereof is known. This makes the setup a variable solution for nearly each room.

Figure 2G:
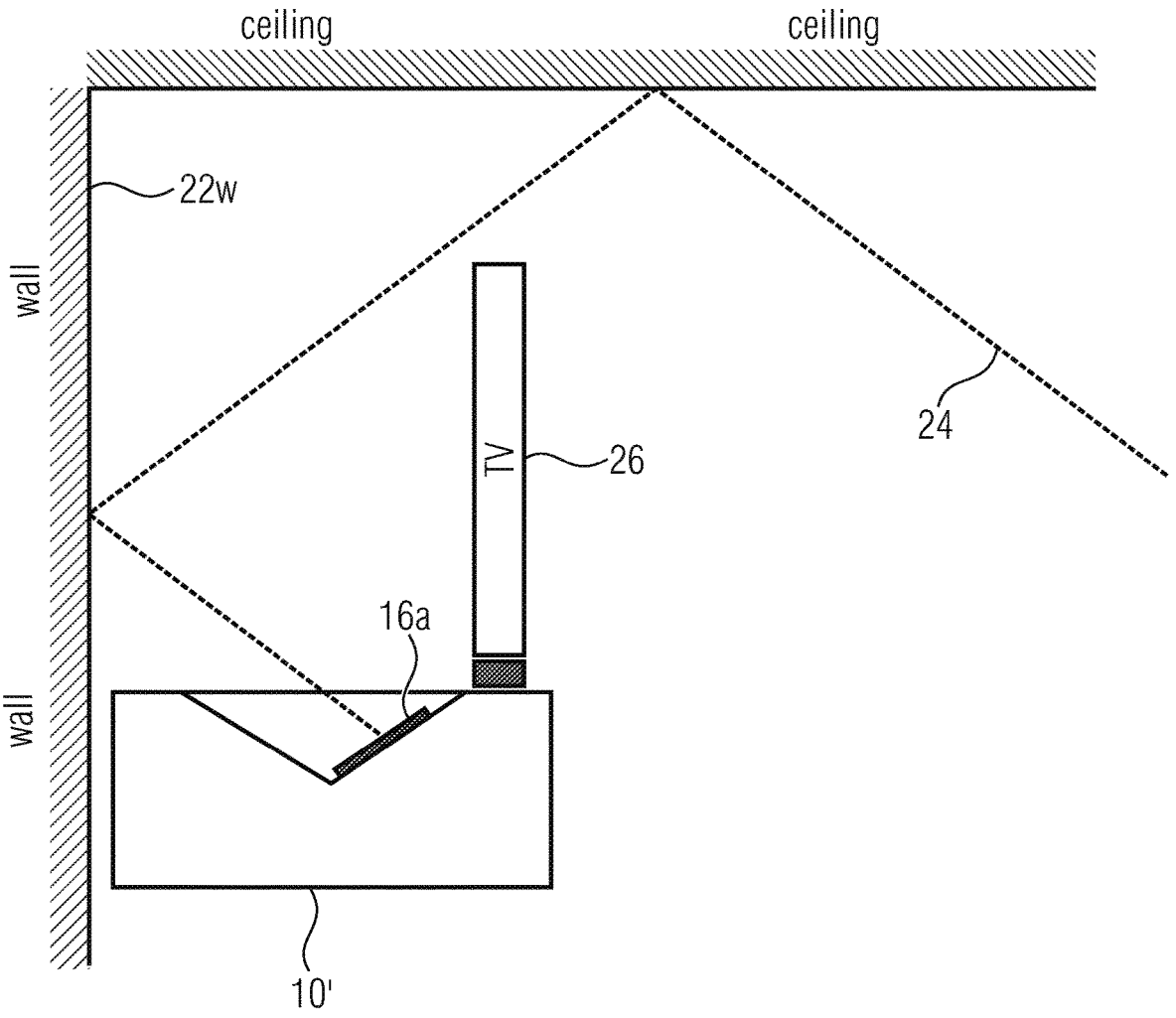

Another option for placing the soundbar 10' is to place same behind the screen 26, which results in different properties of the device. This embodiment is illustrated by FIG. 2*g*. FIG. 2*g* shows the soundbar 10' arranged as discussed with respect to FIG. 2*c* (i.e. that the soundbar emits a sound signal traveling along the sound path 24 using the transducer 16*a*), wherein the television 26 is arranged at the front side of the soundbar 10'. The result of this arrangement is that the transducer 16*a* is arranged between the wall 22*w* and the screen 26. This has the effect that the sound emitted by the transducer 16*a* is shielded by the back side of the screen 26. Expressed in other words, that means that the driver 16*a* is located behind the TV screen 26. Thus, the vertically oriented reflecting surface will be the back wall 22*w* behind the TV screen 26. In that case, the TV screen 26 acts as an acoustic barrier to further reduce the undesired emission of the sound towards the listener without being reflected. This is considered to further improve the reproduction quality. Additionally, such an arrangement is desirable from an psychologic/esthetic point of view because the upwards pointing loudspeaker driver 16*a'* is hidden from the listener's eyes and the front of the TV screen 26 can be arranged in line with the front of the device 10'.

Additionally, it should be noted that if the device is used without a TV screen 26, it should be positioned near the reflecting wall 22*w*. Although the acoustic barrier through the TV screen 26 is missing in that case, a height reproduction will still be possible. The performance will be comparable to the setup which uses the TV screen 26 as a reflector. Here, it should be noted that an alternative reflector may be provided. Thus, embodiments refer to a system comprising the soundbar, e.g. the soundbar 10 or 10', and a vertically oriented reflector. In this case, or in most cases, the horizontally oriented reflecting object will be the listening room ceiling 22*c*. However, if the listening room is very high, there might be an additional reflector (not shown) suspended at an appropriate height.

Figure 3A:
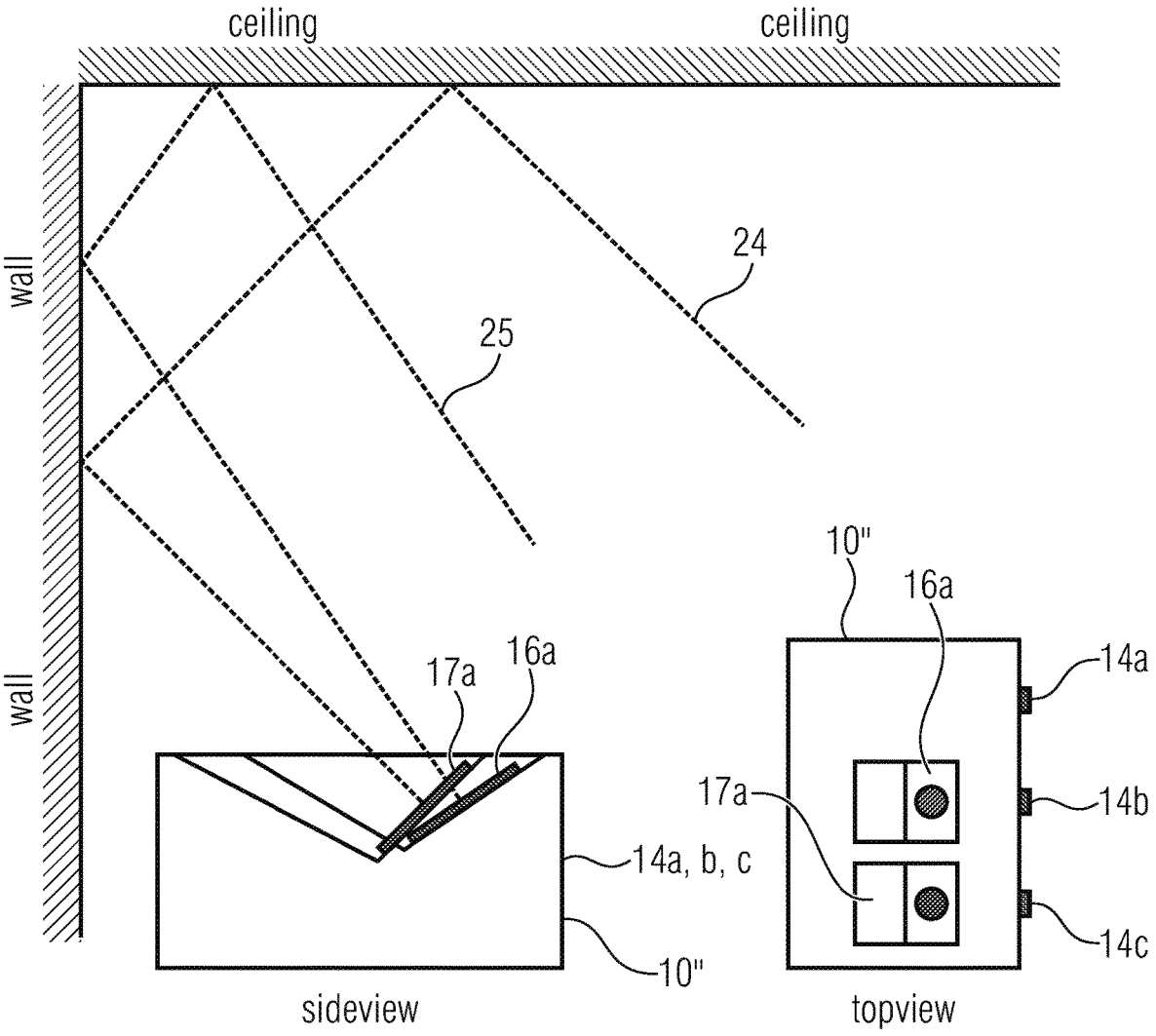
FIGS. 3*a*, 3*b* show further embodiments of soundbars having a complex transducer arrangement.

FIG. 3*a* shows an enhanced embodiment of the soundbar, namely the soundbar 10". The soundbar 10" comprises the transducers 14*a* to 14*c* at the front side and the at least one transducer of a second group 16*a* at the top side. Additionally, a further transducer 17*a* is arranged at the top side, wherein this further transducer 17*a* forms a different angle with respect to the transducers 14*a* to 14*c*. Consequently, the transducers 17*a* and 16*a* form an angle in between, as illustrated by the top view of the device 10". The transducers 16*a* and 17*a* may be arranged adjacent to each other on the top side, or in more detail within a recess of the top side.

Due to the different tilts of the transducers 16*a* and 17*a*, the transducers emit sound signals traveling along the paths 24 and 25, wherein both paths are paths having reflections of a second order. Due to the two different paths 24 and 25, it is possible to transmit two (equal or different) height signals impinging the listener at the listener's position. As illustrated, the two different paths 24 and 25 impinge the listener's position such that one signal (cf. path 25) impinges at the front of the listener's position, wherein the second signal 24 impinges behind the listener at the listening position. Expressed in other words, this means that the two impinging sound signals 24 and 25 have different inclination angles in order to provide a wider listening area. Another use case for two or more drivers with different tilts are drivers which are used for the reproduction of different frequency ranges of the signal that is to be reproduced from above. And since different types of speakers, e.g. a broadband speaker and an additional tweeter, have different directivity characteristics, different tilt angles can be used to optimize the radiation pattern.

Figure 3B:
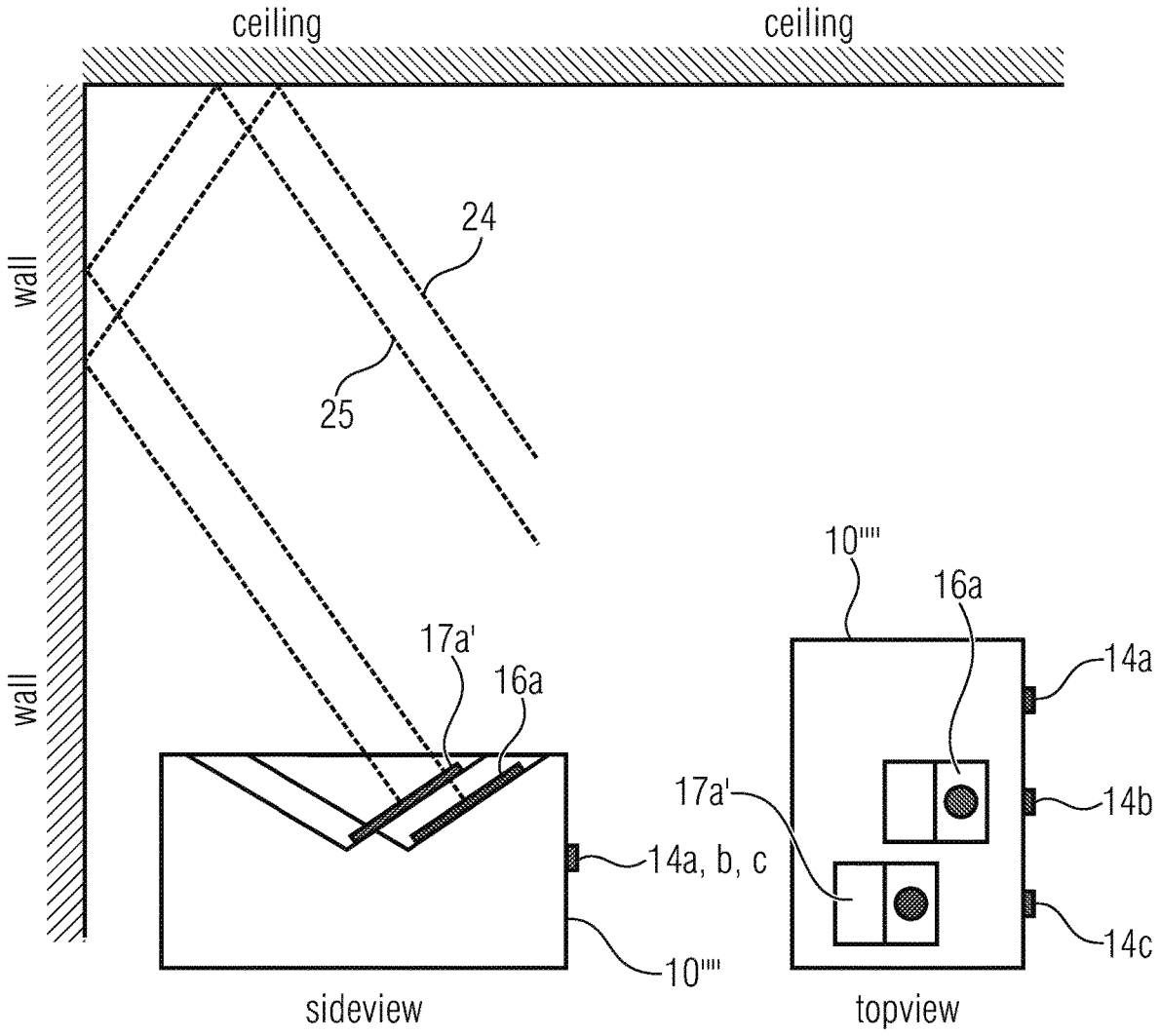

A similar effect may be achieved using the transducers 16*a* and 17*a*' arranged at the top side of the soundbar 10'" as illustrated by FIG. 3*b*. Here, the transducers 16*a* and 17*a*' are arranged in parallel to each other (i.e. have the same angle between the respective transducers 17*a*' and 16*a* and the transducers 14*a* to 14*c*, wherein the transducers 17*a*' and 16*a* are arranged with different distances to the longitudinal side of the transducer 10"" as illustrated by the top view of the transducer 10"". Due to this, the sound signals 24 and 25 impinge at the listener's position such that a wider listening area is covered by their reflected sound 24 and 25.

Figure 4A:
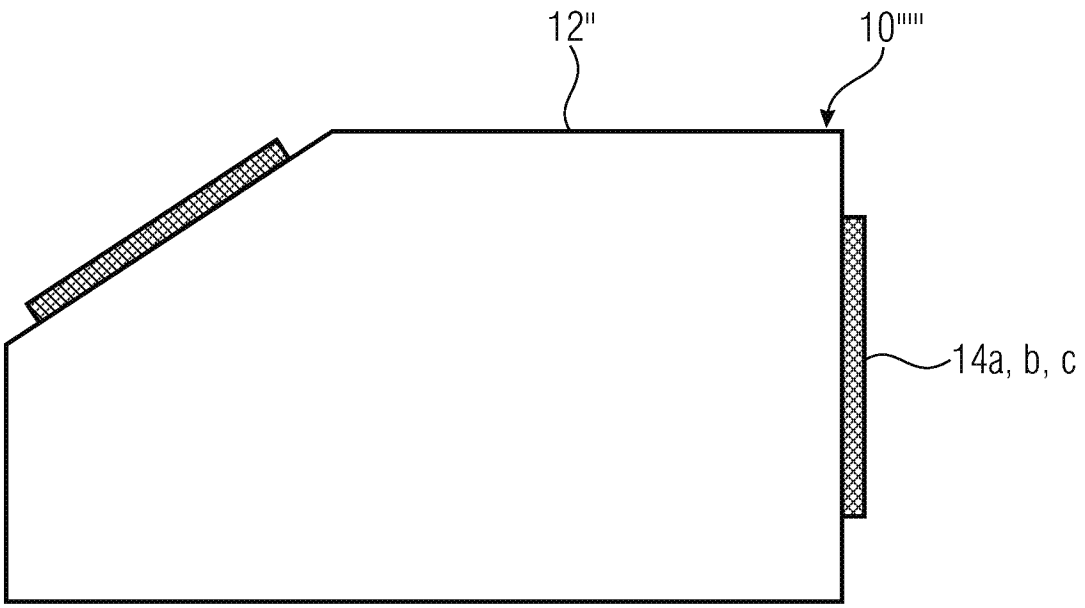
FIGS. 4*a*, 4*b* show further embodiments of soundbars having an alternative transducer arrangement.
Figure 4A:
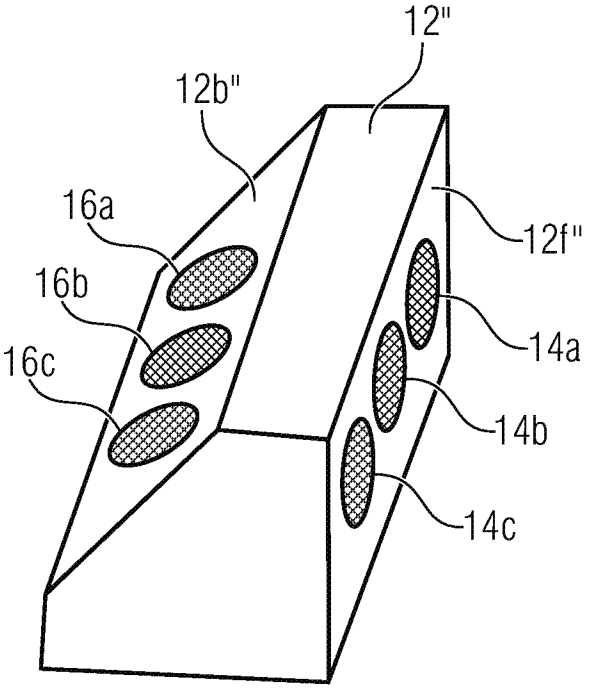

Although the above embodiments have been discussed in the context of a soundbar having a rectangular cross-section, it should be noted that the soundbar may also have a different shape, as illustrated by FIG. 4*a*.

FIG. 4*a* shows a soundbar 10"" having a pentagonal housing 12", wherein the transducers 14*a* to 14*c* are arranged at the front side 12*f*" and wherein a plurality of transducers of the second group 16*a* to 16*c* are arranged at a beveled plane 12*b*" which is arranged opposite to the plane 12*f*". As a consequence of this, the planes 12*b*" and 12*f*" and consequently, the directions into which the sound is emitted by the transducers 14*a* to 14*c* and 16*a* to 16*c* forms an angle β in between which has more than 90°, e.g. 100° or 110°.

Figure 4B:
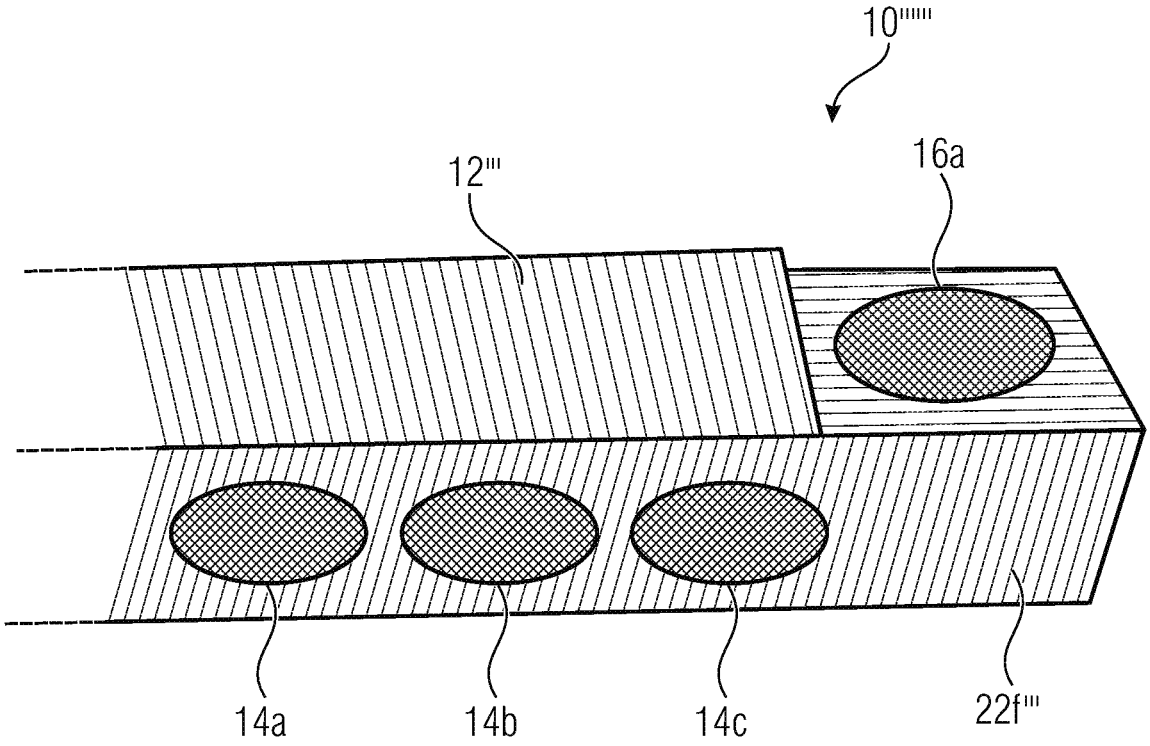

FIG. 4*b* shows another embodiment of a housing of a soundbar 10"", wherein the housing 12'" has a rectangular cross-section. Here, the transducers 14*a* to 14*c* are arranged at the front side 12*f*", wherein the transducers 16*a* arranged at the top side of the housing 12'" is arranged at a portion of the top side which is angled with respect to the entire top side, such that the angle portion of the top side forms an angle β with respect to the front side 12*f*" being larger than 90°.

Figure 5:
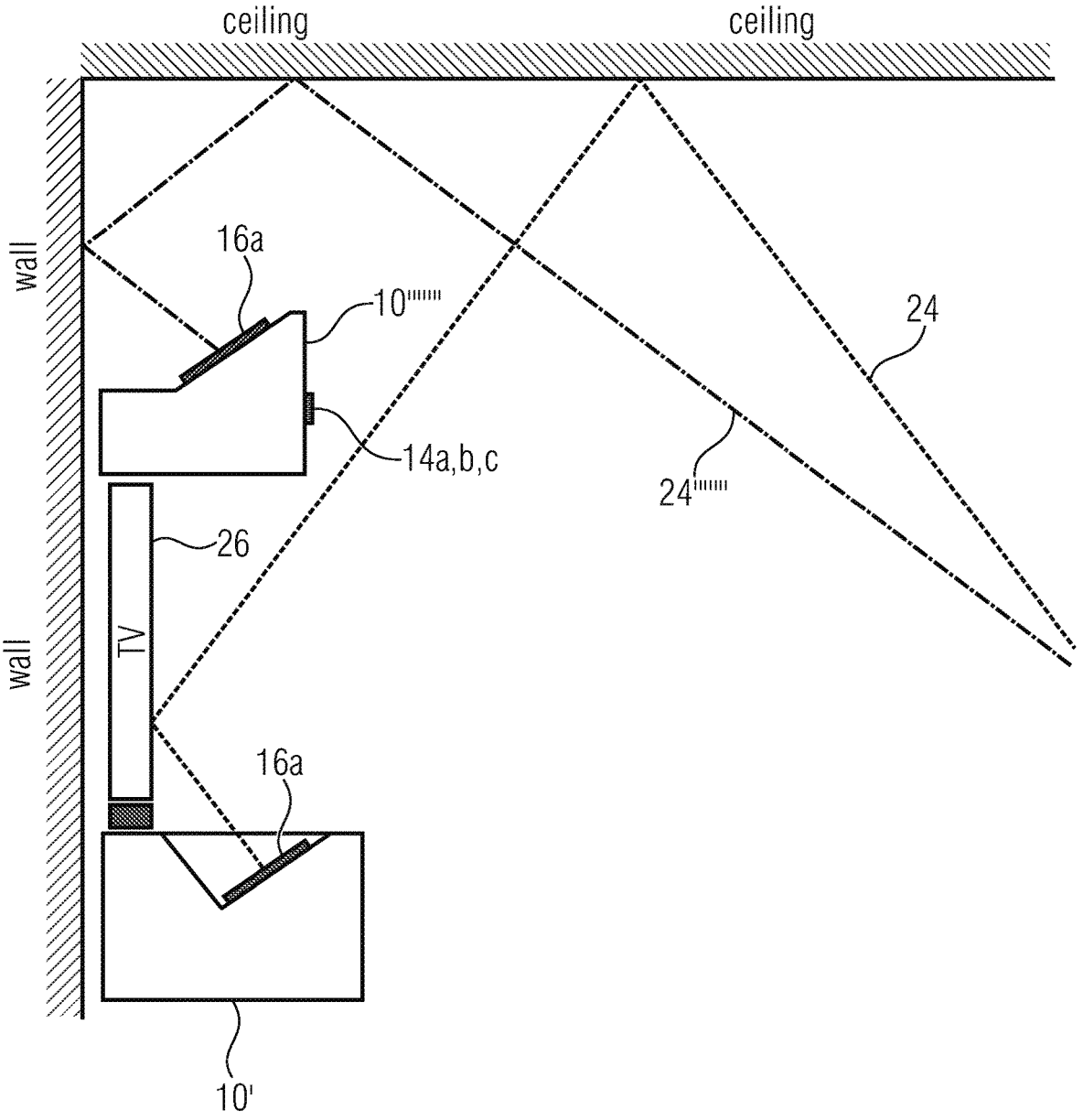
FIG. 5 shows a special setup with two soundbars.

FIG. 5 shows an exemplary sketch of using more than one soundbar. Here, the soundbar 10' is arranged below the TV screen 26, as explained with respect to the embodiment of FIG. 2*e*, wherein an additional soundbar 10"" is arranged above the TV screen 26. Here, the soundbar 10"" has an orthogonal shape, wherein the transducers 14*a* to 14*c* and 16*a* of the two different groups are arranged such that same form an angle α of 90° or less in between. In this example, the respective second emission direction of the transducer 16*a* of the two soundbars 10' and 10"" are selected such that both impinge at the listener's position, cf. part 24 and 24"".

Figure 6A:
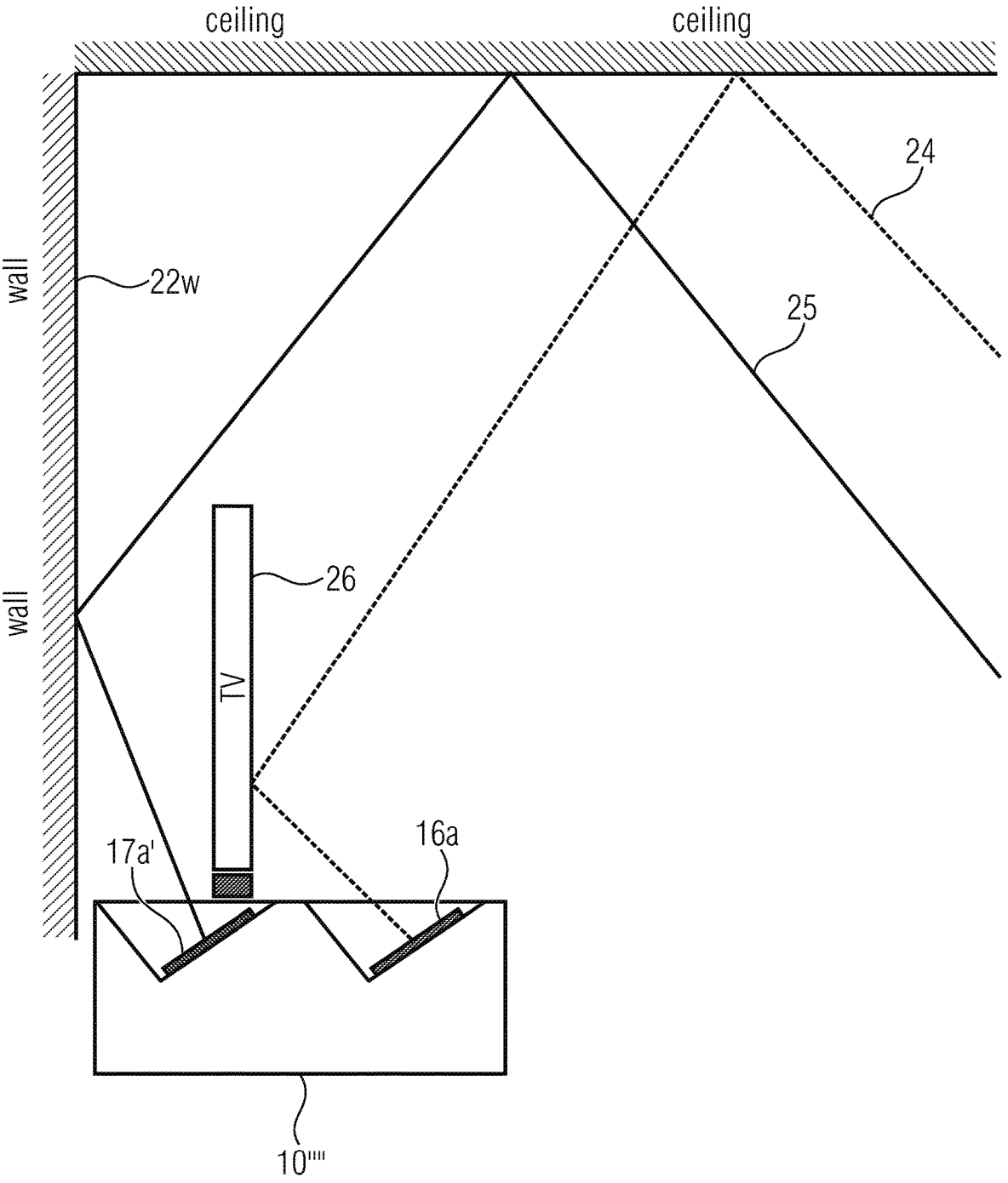
FIGS. 6*a*, 6*b* show further embodiments of soundbars having a complex transducer arrangement together with their respective setup.

FIG. 6*a* shows a setup of the soundbar 10"" which has the two transducers 16*a* and 17*a*' being arranged with different distances to the longitudinal edge of the sample 10"", wherein the screen 26 is arranged such that the signal of the transducer 16*a* is reflected by the screen 26 and such that the signal of the transducer 17*a*' is emitted behind the screen 26 and reflected by the wall 22*w* and shielded by the screen 26. As illustrated by the two paths 24 and 25, the height audio signal impinges at the listener's position in a manner having a wider listening area.

Figure 6B:
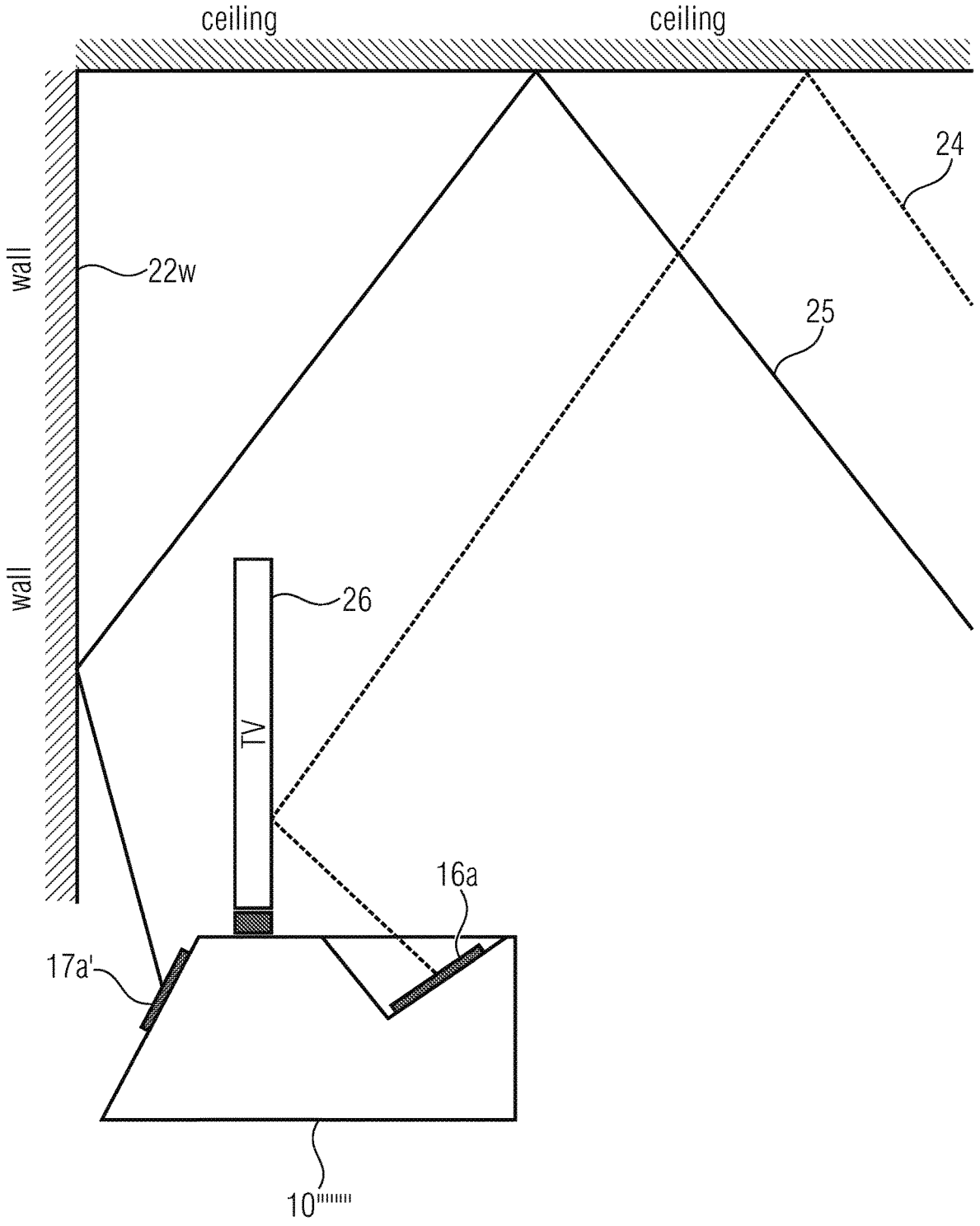

A substantially similar situation is illustrated by FIG. 6*b*, wherein the soundbar 10"" has the transducer 16*a* arranged at a recess in the top side and a transducer 17*a*' arranged at a back side of the housing, wherein the back side and the front side have a tilt α of less than 90°. Consequently, the signal of the transducer 16*a* is reflected by the screen 26, wherein the signal of the transducer 17*a*' is reflected by the wall 22*w*. As a consequence, the two audio signals 24 and 25 impinge at the listener's position in a manner forming a wider listening area.

Figure 7A:
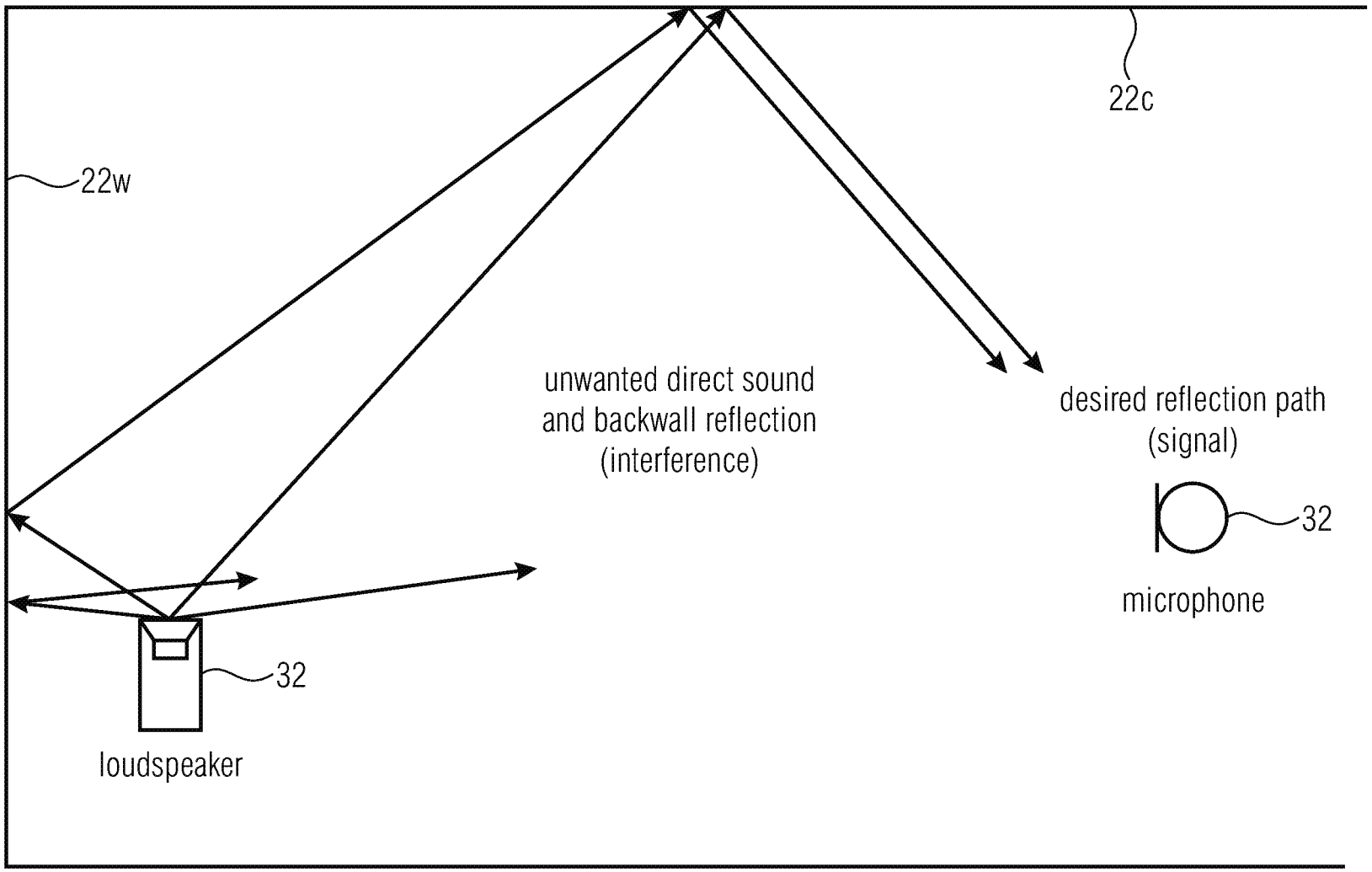
FIG. 7*a* shows a test setup of the upward oriented loudspeaker/soundbar according to an embodiment.

With respect to FIGS. 7*a* and 7*b* the benefits of tilting upward-oriented loudspeakers 16*a* towards the back wall 22*w* instead of directly towards the ceiling 22*c* will be discussed. Here, FIG. 7*a* shows the test setup in which the test loudspeaker 30 is arranged next to the back wall 22*w* and the microphone 32 at the listener's position. The test loudspeaker 30 is generally oriented upwards, wherein the tilt is varied during the measurement.

Figure 7B:
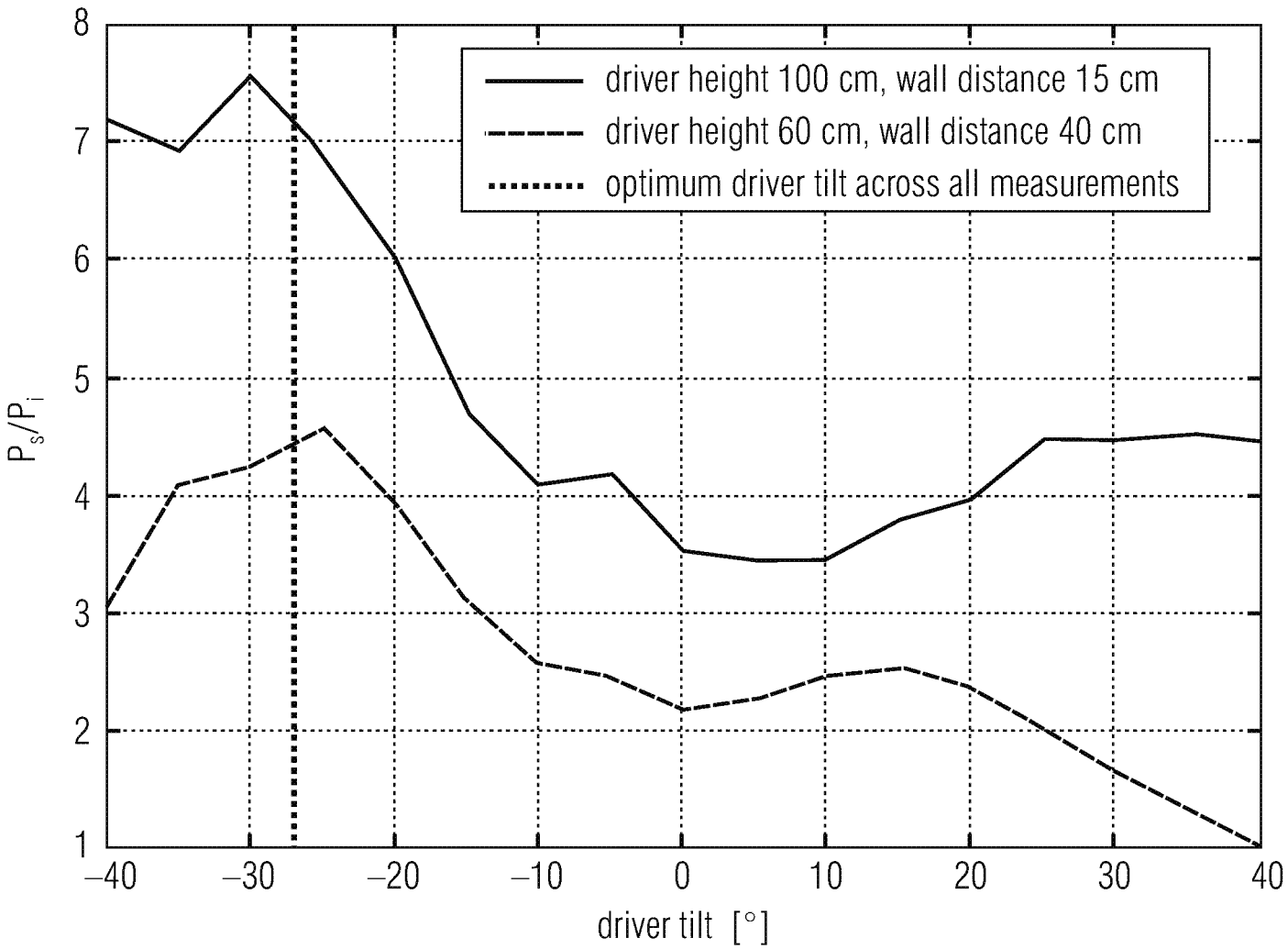
FIG. 7*b* shows a diagram illustrating the results of the measurement using the test equipment of FIG. 7*a*.

The results for two different vertical positions of the test speaker 30 of the measurement is illustrated by FIG. 7*b*. FIG. 7*b* shows a diagram of the desired reflection path signal ($p_{signal}$) and the unwanted interference signal ($p_{interference}$) plotted over the driver tilt.

In the test setup of FIG. 7 the upward oriented loudspeaker 30, is placed closely to the wall 22*w* at different heights and wall distances, and the microphone 32 is at 2.5 meter from the wall. The transfer function between the loudspeaker 30 and the microphone 32 is measured for variety of driver tilt angle ranging from −45° to +45°, wherein negative angles describe an orientation towards the back wall 22*w*. Sound reaching the listener from the front, either directly or via a first order reflection, are considered unwanted and their respective energy is accumulated into the total interference power ($p_{interference}$). All sound reaching the listener via reflections from the top, i.e. from the ceiling 22*c*, e.g. via first order or second order reflections (i.e. "ceiling to listener", or "back wall to ceiling to listener"), are considered desired signal $p_{signal}$. Thus, the optimum loudspeaker tilt angle is indicated by a maximum of the energetic ratio between the signal and interference, $p_s$ to $p_i$. An advantage of the backward-oriented loudspeaker is that less energy propagates on the direct unwanted path to the listener as compared to the case when the loudspeaker is oriented directly towards the ceiling (cf. FIG. 7*b*). This effect is even emphasized towards higher frequencies, as the loudspeaker starts to focus.

Although some of the above embodiments have been discussed in the way that just one transducer of the second group (cf. reference numeral 16*a*) is arranged at the top side or back side or the recess of the soundbar, it should be noted that a plurality of transducers of the second group may be arranged at the top side.

In some embodiments, the side at which the transducers of the second group are arranged has been discussed so to form an angle α being smaller than 90° to enable angle of larger than 90° between the first and second emission direction, it should be noted that the angle β may also be 90° or more (cf. FIG. 1*b*). However the interior angle α may also be equal or larger than the 90° when beamforming is used to direct the second direction so that the angle β between the first and the second direction amounts to at least 90° or to more than 90°.

Referring to the above discussed one or more audio signals used for controlling the traducers of the first and second group, it should be noted that each audio signal (first/second audio signal) may comprise many channels, the first/second audio signal may comprise many channels.

Additionally it should be noted that the first and second audio signals differ from each other with respect to their content (e.g. they are provided by different discrete audio channels), or the difference may consist of (but is not limited to) gain modification, decorrelation and/or filtering, e.g. high-pass filtering, which are ideally time varying and/or frequency dependent.

Referring to the height information of the second audio signal it should be noted that the height information may be carried by a separated channel or generated by an upmixing.

Here, it should be noted that the above embodiments are just illustrative, wherein the scope of protection is limited by the following claims.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A soundbar to be used in combination with a screen and arranged within a room such that a vertical surface within the room is used for a vertical reflection and a horizontal surface of the room is used for a horizontal reflection, the soundbar comprising:

a housing, wherein the housing comprises a first and a second recess within a second side;

transducers of a first group, wherein all transducers of the first group are arranged at a front side of the housing and configured to emit sound in a first direction in accordance with at least two first audio signals comprising many channels so as to reproduce a two dimensional sound field; and transducers of a second group wherein all transducers of the second group are arranged within the first and the second recess and configured to emit sound in a second direction in accordance with at least one second audio signal such that the sound emitted by the transducers of the second group reaches a predefined listener position in a reflected manner to extend the two dimensional sound field in a height dimension;

wherein the first and the second direction form an angle of more than 90°; and wherein a height audio signal of a 3D surround reproduction is reproduced using the transducers of the second group;

wherein the sound emitted by the transducers of the second group is reflected by the vertical surface first and by the horizontal surface second, wherein the reflection reflecting the sound emitted by the transducers of the second group comprises an order of at least two;

wherein the second group comprises two subgroups, each subgroup comprising one or more transducers, wherein the one ore more transducers of a first of the two subgroups are arranged in a first recess and wherein the one or more transducers of a second of the two subgroups are arranged in the second recess and wherein the transducers of the two subgroups differ from each other with regard to a distance to a longitudinal edge of the housing, wherein the screen is arranged such that signals of the transducers of the first of the two subgroups is reflected by the screen and such that signals of the transducers of a second of the two subgroups is emitted behind the screen and reflected by a wall and shielded by the screen.

2. The soundbar according to claim 1, wherein the horizontal reflection is performed using a ceiling of the room in which the soundbar is arranged.

3. The soundbar according to claim 1, wherein the soundbar comprises a unit for mounting the screen.

4. The soundbar according to claim 1, wherein the second group comprises at least two transducers and wherein the sound of the at least two transducers of the second group is emitted using beam forming such that the second direction and the first direction form an angle comprising 90° or more.

5. The soundbar according to claim 1, wherein the transducers of the first group and the transducers of the second group are of the same type; and/or wherein the transducers of the first group and the transducers of the second group exhibit the same frequency response.

6. The soundbar according to claim 1, wherein the transducers of the first group and/or the transducers of the second group are configured to emit sound such that sound is horizontally directed away from the predefined listener position.

7. The soundbar according to claim 1, wherein the recess comprises a V-shape; and wherein the transducers of the second group is arranged at one plane of the V-shaped recess which is turned away from the front side.

8. The soundbar according to claim 1, wherein the first audio signals differ from the second audio signals.

9. A system comprising:

a soundbar according to claim 1; and a screen for reflecting the sound emitted by the transducers of the second group or a vertical reflector for reflecting the sound emitted by the transducers of the second group and/or a horizontal reflector for reflecting the sound emitted by the transducers of the second group.

10. The system according to claim 9, wherein the sound emitted by the transducers of the second group is shielded by a back surface of the screen such that the screen forms a barrier shielding the sound that is erroneously emitted within the first direction.

11. The system according to claim 10, wherein the soundbar comprises a unit for mounting the screen.

12. The soundbar according to claim 1, wherein the transducer of the first of the two subgroups is arranged behind the screen and the transducer of the second of the two subgroups is arranged before the screen.

13. The sound bar according to claim 1, wherein each of the two subgroups comprises at least two transducers.

* * * * *